United States Patent [19]

Skillicorn et al.

[11] Patent Number: 5,077,771

[45] **Date of Patent: * Dec. 31, 1991**

[54] HAND HELD HIGH POWER PULSED PRECISION X-RAY SOURCE

[75] Inventors: Brian Skillicorn, Sunnyvale; David C. Reynolds, Aptos; Richard S. Burrow, Morgan Hill, all of Calif.

[73] Assignee: Kevex X-ray Inc., Scotts Valley, Calif.

[ * ] Notice: The portion of the term of this patent subsequent to Sep. 15, 2004 has been disclaimed.

[21] Appl. No.: 317,456

[22] Filed: Mar. 1, 1989

[51] Int. Cl.[5] ..... H05G 1/06; H05G 1/34; H05G 1/38; H05G 1/10

[52] U.S. Cl. ..... 378/102; 378/110; 378/111; 378/103; 378/104; 378/106; 378/114; 378/136; 378/138

[58] Field of Search ..... 378/101, 103, 102, 104, 378/105, 106, 110, 111, 114, 136, 138, 121; 363/17, 25, 26

[56] References Cited

U.S. PATENT DOCUMENTS

| | | | |
|---|---|---|---|
| 3,256,439 | 12/1962 | Dyke et al. | 250/98 |
| 3,878,394 | 4/1975 | Golden | 250/402 |
| 4,104,526 | 8/1978 | Albert | 378/106 |
| 4,378,501 | 3/1983 | Cowell | 378/106 |
| 4,517,472 | 5/1985 | Ruitberg et al. | 307/82 |
| 4,646,338 | 2/1987 | Skillicorn | 378/110 |
| 4,694,480 | 9/1987 | Skillicorn | 378/119 |
| 4,783,613 | 11/1988 | Yamamoto et al. | 313/633 |

*Primary Examiner*—Edward P. Westin
*Assistant Examiner*—Don Wong
*Attorney, Agent, or Firm*—David B. Harrison

[57] ABSTRACT

A pulsed precision x-ray source includes a miniaturized internally self-shielding x-ray tube and an integral generator contained in a hand-held housing for generating timed bursts of x-ray having regulated energy level. A control grid and focus electrode within the tube enable precise on-off control of an electron beam directed to an x-ray emitting anode. The integral generator system includes an elongated, U-shaped unitary, molded plastic block mounted in the housing and includes a high voltage transformer having primary and secondary annular windings encased in a transformer portion of the block defining a central opening outside of the block for receiving a transformer core therethrough and, a capacitor-diode voltage multiplier stack connected to the secondary winding and having a positive node connectable to the anode and a negative node connectable to the cathode. A high voltage pulse width modulated switching circuit is connected to the primary annular winding to generate high voltages across said voltage multipler stack in order to control the energy of x-ray put out by the tube. A heater power supply supplies heater current to operate a heater in the tube. A focus element/grid control voltage power supply generates control voltages. A control circuit controls application of the control voltages to the focus element and the grid in order to switch the electron beam on and off in accordance with a preset value.

41 Claims, 15 Drawing Sheets

PORTABLE X-RAY UNIT 10
FUNCTIONAL BLOCK DIAGRAM

210
VCC
LOG
TRIG
V+
VREF
COL
R/C
GND
EMIT
LM3905
208
4069
1N4448
168
1N4448
212
4069
176
215
220
4538
RC
CX
+T
-T
R
Q
VCC
228
TRIG
R
C
M
O
D
VREG
R
TBO
UA2240
PD58
PD59
TP6
156

HAND HELD HIGH POWER PULSED PRECISION X-RAY SOURCE

FIELD OF THE INVENTION

The present invention relates to equipment for generating x-ray energy. More particularly, the present invention relates to improvements in a miniaturized, modular, light weight precision x-ray source with integral generator for generating high power pulsed increments of x-ray photons wherein each increment has a precisely controlled interval during which controllable x-ray energy and intensity levels are generated and put out.

BACKGROUND OF THE INVENTION

Substantial recent progress has been made by the assignee of the present invention in the development and refinement of miniaturized, compact, hand-held precision x-ray sources including integral precision power supplies (known as "generators" in the x-ray art). The reader is referred to the commonly assigned prior U.S. Pat. Nos. 4,646,338 and 4,694,480, and the disclosures thereof are expressly incorporated herein by reference thereto as examples of the assignee's ongoing developments in this art.

While the hand held precision x-ray source described, for example, in the referenced U.S. Pat. No. 4,694,480 worked very well, particularly for spectrometric data collection uses and environments requiring continuous generation of X-rays of precise energy and intensity over an extended time period, that prior source has manifested several drawbacks in some desirable applications and operating environments. First, that prior unit was limited to generating x-ray energy from high voltage levels of no greater than fifty kilovolts, and x-ray intensity levels from beam current levels of only one hundred milliwatts. For many useful applications, including imaging applications, the relatively low x-ray power level provided by the referenced prior unit failed to result in sufficiently energetic x-ray generation and failed to provide satisfactory images, particularly in dental and chest x-ray applications.

Also, in radiographic imaging applications; the requirement of constant x-ray excitation was not present, and a pulsed excitation source became essential from a safety and operating point of view. In addition, when used with electronic imaging systems for digital image storage or for direct viewing on a television screen, it has become sometimes desirable to have the x-ray pulse period as short as one millisecond with the pulse commencement capable of being synchronized with the imaging system with which the pulsed source is being used.

A related drawback of prior approaches to pulsed x-ray generation having controlled energy levels relates to x-ray tube construction. With grid controlled x-ray tubes, unless care is given to the design, manufacture and operating conditions of the x-ray tube, application of high beam acceleration voltage across the electron gun assembly and the target anode tends to cause stray electron emission from cathode material which has migrated to the heated control grid and focus grid elements of the electron gun assembly, even though a negative beam-cutoff potential has been applied to the control grid. Stray electron emission results in unwanted and uncontrolled x-ray generation, leading directly to imprecision and safety issues in small, hand-held portable x-ray sources.

Another drawback of the cited prior hand-held unit was its relative weight which was directly attributable to extensive external lead-sheet x-ray shielding required at and around the x-ray tube in order to eliminate any stray x-ray photon radiation.

Another drawback of the referenced prior art approach was the lack of a circuit within the precision x-ray generator to provide a precise, controllable time increment for the x-ray pulse duration.

A further drawback of the common-assignee's referenced prior art unit was that it was not sufficiently ruggedized to withstand potentially rough handling necessarily incident to field use and handling of any hand-held apparatus.

Other workers have proposed pulsed portable x-ray sources as taught, for example, by the Golden U.S. Pat. No. 3,878,394, and the Dyke et al. U.S. Pat. No 3,256,439. However, those prior approaches used spark gap and transmission line generator technology and thus were not capable of providing x-rays of precisely controllable duration, intensity or energy.

Ruitberg et al. U.S. Pat. No. 4,517,472 described an x-ray generator for exciting an x-ray tube fitted with a focus grid in order to control electron beam width and shape. Although three separate DC switching power supplies were used, the Ruitberg et al. approach did not provide any beam gating grid control and therefore was not a pulsed x-ray beam system.

Thus, a hitherto unsolved need has arisen for a truly portable, battery operated x-ray generator capable of generating x-rays of presettable energy, intensity and precisely controllable duration.

SUMMARY OF THE INVENTION WITH OBJECTS

A general object of the present invention is to provide a miniaturized, modular, ruggedized, light weight precision x-ray source with integral generator for generating high power increments of x-ray photons with precisely controlled and regulated duration, energy and intensity levels, by providing a structure and functionality which overcomes the limitations and drawbacks of the prior art approaches.

A specific object of the present invention is to provide within the generator an improved high voltage block design which reduces the amount of potting material and which enables more efficient and concentrated usage of x-ray shielding material such as lead sheet material, thereby reducing overall weight of the x-ray source and its high voltage generator and facilitating packaging thereof within a hand holdable ruggedized, high impact housing.

Another specific object of the present invention is to provide a ruggedized, grippable housing for a portable x-ray source and integral generator unit which enables the operator securely to maintain positioning control of the unit while enabling the operator to operate the unit easily and safely.

Yet another specific object of the present invention is to provide an improved, grid controlled x-ray tube design which precludes stray electron emission in the presence of operating potentials while intended emission is cut off by grid and focus element bias potentials and which includes external and internal shielding in order to contain and limit the field of view of x-ray photons to a desired exposure window area, thereby reducing shielding requirements at the operating environment.

A further specific object of the present invention is to provide improved and advanced control electronics which generate precisely timed x-ray pulse duration control signals for effectively controlling an x-ray tube so that each x-ray pulse increment put out by the tube is of a controllable, precise duration within a relatively large time interval range, as well as of controllable precise energy and intensity levels.

Another specific object of the present invention is to provide circuitry for synchronization of each x-ray pulse with an external electronic imaging system.

One more specific object of the present invention is to provide a lock out timer circuit so that the source may be operated with a limited duty cycle, thereby increasing greatly the energy and intensity levels of each precisely controlled x-ray pulse interval without generating excessive heat dissipation in the x-ray tube structure.

Yet a further specific object of the present invention is to provide a heater boost circuit which boosts heater current during an initial operational state of the source, after which, heater current is reduced to normal operating values, for the purpose of bringing the x-ray tube to operating condition in a very short time period immediately before each period of use.

One more specific object of the present invention is to provide a beam intensity regulation circuit within a pulsed x-ray tube source which maintains a regulated uniform electron beam intensity as the tube heater ages and electron emission otherwise diminishes over time.

An additional specific object of the present invention is to provide a battery economizer circuit by which the heater is automatically deenergized after a pretermined time interval if the x-ray source has not been operated during that time interval.

One more specific object of the present invention is to provide a modular, light weight hand holdable and alignable precision x-ray source and integral generator unit which has been ruggedized to withstand the harshest field operating conditions and situations.

In accordance with the principles of the present invention, a pulsed precision x-ray source includes a miniaturized internally self-shielding x-ray tube and an integral generator system contained in a hand-held high impact and ruggedized housing for generating timed bursts of x-ray photons having regulated intensity and energy level. A control grid and focus element structure within the tube enables on-off control of an electron beam directed to an x-ray emitting anode structure by application thereto of control voltages relative to a cathode element of the x-ray tube. The integral generator system includes an elongated, U-shaped unitary, molded plastic block structure mounted in the housing and includes a high voltage transformer having primary and secondary annular windings encased in a transformer portion of the block defining a central opening outside of the block for receiving a transformer core therethrough and, a capacitor-diode voltage multiplier stack connected to the secondary winding and having a positive node connectable to the anode and a negative node connectable to the cathode. A high voltage pulse width modulated switching circuit is connected to the primary annular winding to generate controlled high voltages across said voltage multiplier stack in order to control the energy of x-ray photons put out by the x-ray tube. A heater power supply supplies regulated heater current to operate said x-ray tube heater. A focus element/grid control voltage circuit generates control voltages, and a control circuit controls application of the control voltages to the focus structure and to the grid in order to switch the electron beam beam on and off during a controlled duration of beam-on pulse time in accordance with a preset value.

The x-ray tube preferably includes an indirectly heated thermionic emission cathode operating at approximately ground potential; an anode emitting x-rays as a consequence of bombardment of an accelerated electron beam emitted by the cathode along a beam path from the cathode leading to the anode; a control grid and a focus element disposed in the beam path for on-off control of the beam in accordance with application to the grid of a grid bias beam control voltage, and with application to the focus element of a focus bias voltage, relative to the cathode; and internal x-ray shielding in order to minimize external shielding material and overall weight of the source system.

The integral generator includes an elongated, unitary, molded plastic block structure mounted in the housing and having two generally parallel, cylindrical tube sections joined together along a rear portion of a central longitudinal axis. Primary and secondary annular windings are encased in a transformer region at the rear portion of the block, the transformer region defining a central opening through the block for receiving a transformer core therethrough. A two part capacitor-diode voltage multiplier stack has center nodes thereof connected to the secondary winding and has a high voltage positive node connectable to the anode and a high voltage negative node connectable to the cathode. A positive terminal providing part of said capacitor-diode voltage multiplier stack is formed in one of the cylindrical tube sections of the block, and a negative terminal providing part of the capacitor-diode voltage multiplier stack is formed in another of the cylindrical tube sections of the block. The one cylindrical tube section defines a well for receiving the x-ray tube therein in a manner by which the anode is thereupon electrically connected to a positive terminal of the positive terminal providing part of the capacitor-diode voltage multiplier stack. X-ray photon energy absorptive shielding material surrounds the tube well-defining cylindrical tube section of the block.

A high voltage pulse width modulated switching circuit is connected to the primary annular winding for passing switching currents therethrough in order to generate controlled high voltages across the voltage multiplier stack in order to establish and control the energy of x-ray photons put out by the x-ray tube.

A heater power supply circuit supplies regulated heater current to operate the x-ray tube heater and to control the temperature of the cathode. The heater power supply circuit desirably includes a heater boost timer circuit for supplying increased heater current to the x-ray tube during an initial warm-up period in order thereby to bring the x-ray tube heater rapidly to operating temperature.

A control circuit is connected to apply control voltages to the control grid and beam focus structure of the x-ray tube in order to switch the beam on and off. The control circuit includes a beam pulse timing circuit for controlling the duration of a beam-on pulse interval in accordance with a preset value, controllable within a range extending from milliseconds to several seconds. The beam pulse timing circuit further comprises a duty cycle timer for establishing a controllable stand-by interval between subsequent beam-on x-ray pulse intervals.

A conditioning circuit within the integral generator enables the application of heater current while the high voltage slowly rises up to its maximum value, this procedure being performed in order to reduce the chance of arc-over after extended periods of disuse.

A ruggedized, high impact reinforced plastic housing is provided with suitable integrally formed handles, and with controls and indicators for operator control of the x-ray source and to enable reliable, fail safe operation thereof. Remote control capability is also provided.

Several feedback and protection loops and circuits are provided to limit the frequency of pulsing of the source and to regulate operating parameters so that x-ray photons generated during the preset beam-on pulse interval will have precise energy and intensity.

Adjustable cathode biasing of the x-ray tube provides for automatic regulation of beam intensity.

These and other objects, aspects, advantages and features of the present invention will be more fully understood and appreciated upon considering the following detailed description of a preferred embodiment, presented in conjunction with the accompanying drawings.

DETAILED DESCRIPTION OF A PREFERRED EMBODIMENT

Structural Aspects of Source 10

Figure 1:
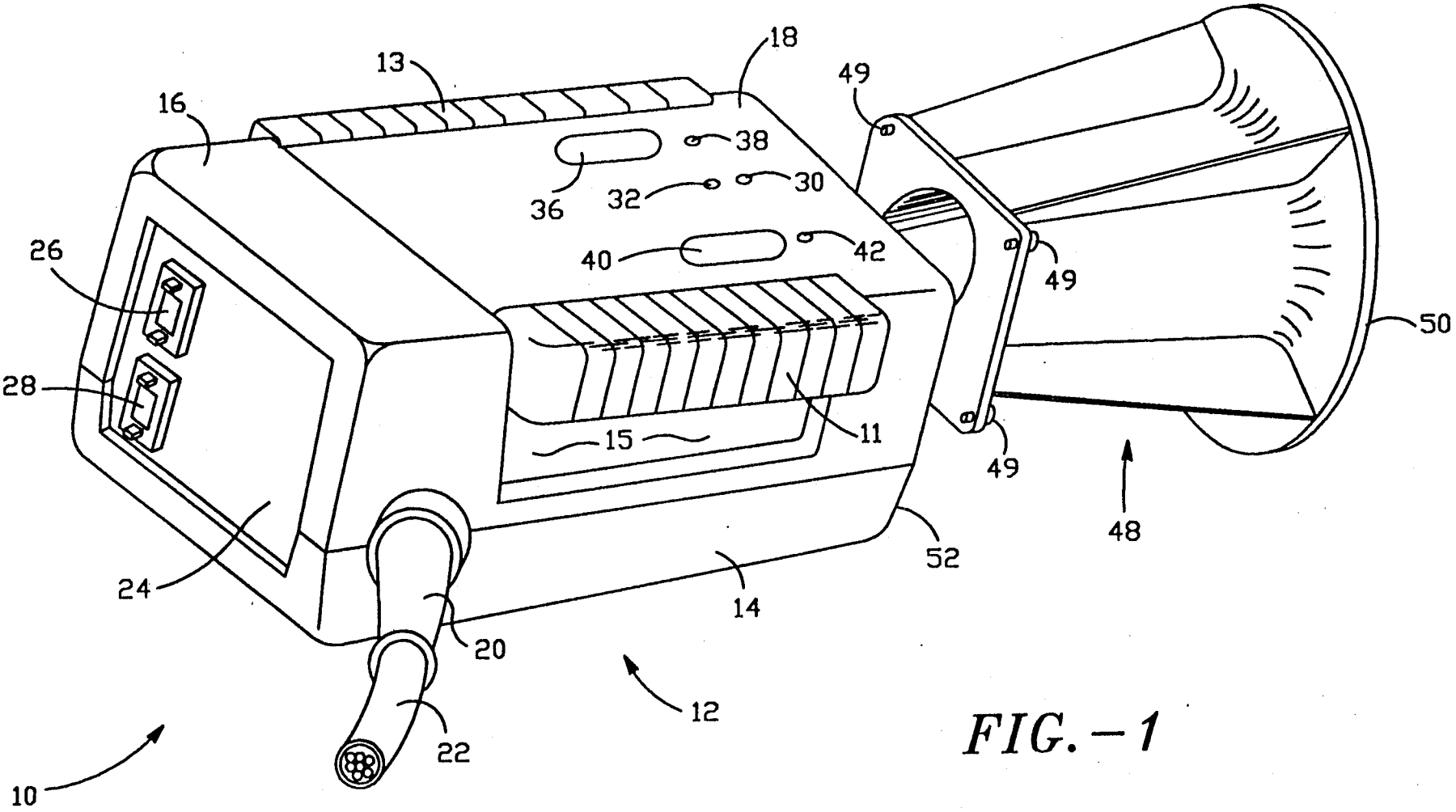
FIG. 1 is a somewhat diagrammatic perspective view of a ruggedized, pulsed precision x-ray source incorporating the principles of the present invention, to which an external x-ray shielding horn is attachable as an adaptation for field dental imaging applications and uses, for example.

A portable, precision x-ray source 10, incorporating the principles of the present invention, includes a ruggedized, elongated box-shaped exterior housing 12, comprising a lower, trough-shaped panel 14 and an upper, trough-shaped panel 16, as shown in FIG. 1. The panels 14 and 16 are preferably molded of a high impact plastic material. A screw thread defining metal insert is preferably included at a center-of-mass location on the lower panel 14 to enable the source 10 to be mounted on a tripod during use, if desired.

Handles 11 and 13 are integrally molded into the upper sides of the upper panel 16. The handles 11 and 13 define recesses for the fingers of the operator, and a recessed portion 15 of each adjacent sidewall of the upper panel 16 further contributes to functionality of the handles. The handles 11 and 13 are arranged so that the operator may securely grip the unit 10 with the fingers of each hand curled respectively around the outside lips of the handles 11 and 13 and still operate two function switches 36 and 40 with the thumbs in a manner enabling positive and safe control of x-ray generation.

A strain relief 20 extends from the right side of the housing 12 as faced from the back. The strain relief 20 contains and secures a power and control cable 22 leading to a suitable low voltage, high current power source (not shown), such as a 28 volt storage battery provided alone or within a vehicle or aircraft system. Other low current conductors located within the power cable 22 enable attachment of the source 10 to a remote control unit (not shown) so that the source 10 may be controlled and synchronized with other equipment from a remote control point, should that be desired.

On the back panel 24, a kilovolt set control 26 enables the operator to enter a desired x-ray energy level in kilovolts, from e.g. about 50 kilovolts up to 70 kilovolts and also set the unit 10 to a conditioning mode, explained in greater detail hereinafter. An exposure interval time duration control 28 enables the operator to enter one of ten selectable x-ray pulse time durations extending in powers of two from 0.004 second to 2.05 seconds, for example.

On a top panel 18 a power indicator LED 30 indicates that primary power is being supplied to the unit 10. A low battery voltage indicator LED 32 indicates to the operator that insufficient primary power is available in order to obtain sufficiently high x-ray energy levels required for satisfactory imaging exposures. This indicator 32 thereby informs the operator that the source unit 10 is locked out of use and not possible until sufficient battery power is obtained or restored, and the unit 10 reset.

A conditioning plate is provided which mounts in place of the cone shield 48 which closes a conditioning switch to enable the conditioning circuitry and permit conditioning of an x-ray tube 44 to occur. Conditioning cycles of the x-ray tube 44 (FIG. 4) within the source 10 (explained hereinafter) may then be safely carried out without creating a risk of unsafe x-ray exposure to the operator.

Several user manupulated thumb controls 36 and 40 and two indicator lamps 38 and 42 are preferably provided in the top panel 18 of the top section 16. A left-thumb kilovoltage switch 36, when depressed, causes high voltage to be applied to the x-ray tube 44 of the source 10. A right-thumb current switch 40, when depressed, causes the tube heater to become activated, initially at a stepped-up current, thereby enabling the indirect cathode of the x-ray tube 44 quickly to come up to operating temperature, as indicated visually by a "ready" lamp 42.

A typical operating sequence for the unit 10 occurs when the current switch 40 is first depressed momentarily, thereby activating the x-ray tube heater in its initial boost mode. After a short interval of a few seconds, the ready lamp 42 becomes activated, indicating that the source 10 is ready to generate a timed interval of x-rays of controlled energy and intensity (energy being established by the kilovoltage set control 28 on the back panel 24). When the kilovoltage control switch 36 is then depressed, the high voltage generator provides a voltage corresponding to the value preselected by the control 28 to the x-ray tube target. While maintaining switch 36 in a depressed mode, depressing the current switch 40 for a second time causes a grid control circuit within the source 10 (explained in greater detail hereinafter) to generate a pulse voltage signal in accordance with the burst duration value set by the exposure control 28 and applies this signal to a grid control element 70 within the x-ray tube 44. During this interval, which is indicated by a "beam on" indicator lamp 38, beam current flows in the tube 44 striking the anode thereof, and resultant x-rays are emitted through a window 46 of the x-ray tube 44 in a narrow cone of energy leading from the front end of the source 10. In the event that the current control switch 40 is not again activated within a predetermined time interval after it has once been activated, the source 10 will automatically turn off the heater power supply and thereafter remain in a low power state.

In FIG. 1 a trumpet shield accessory 48 is shown in a detached position slightly spaced away from a front panel portion 52 of the housing 12 at which the x-ray tube 44 is mounted for x-ray illumination. This shield 48 is preferably formed of an x-ray energy absorptive molded plastic material and is intended to be securely attached to a front end panel 52 of the housing 12 by screws 49. The shield 48 with an end flange 50 absorbs x-rays as may be back-scattered from the item undergoing x-ray examination to prevent x-ray exposure of the operator.

Figure 2:
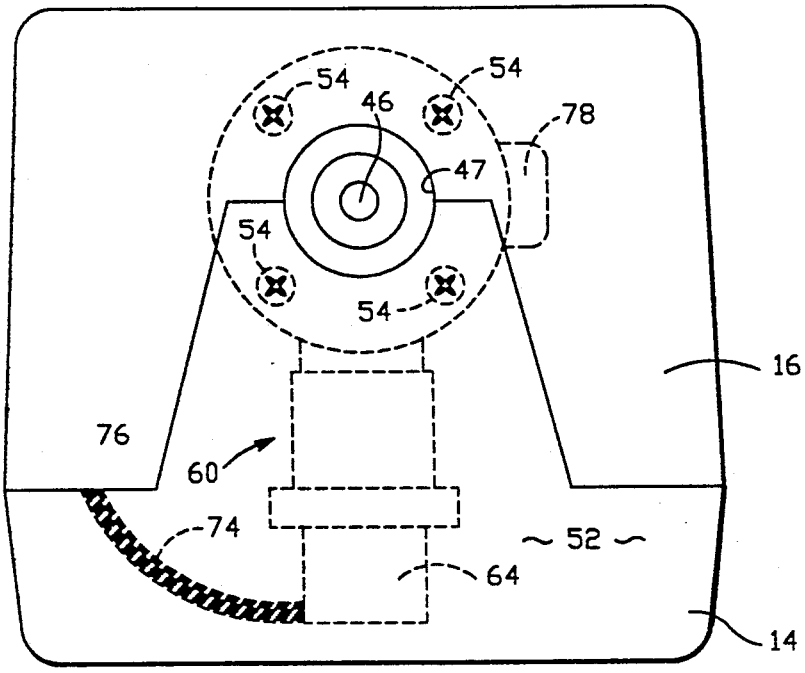
FIG. 2 is a view in front elevation of the x-ray source depicted in FIG. 1.

FIG. 2 depicts the front end panel 52 for the source 10 The x-ray tube 44 is mounted in a well behind the front panel 52 to a mounting plate 53 (FIG. 4) by four screws 54, so that the x-ray window 46 of the tube faces outwardly through an opening 47 formed in the front panel 52. In addition to the x-ray window 46, formed for example of a thin titanium sheet, the tube 44 has a cylindrical shield portion 56 which extends beyond the plate 53 and effectively encloses and thereby shields an anode element 58 of the tube 44 (see FIG. 9 and discussion hereinafter in conjunction therewith).

A shielded electron gun assembly 60, arranged at right angles with respect to, and intersecting the cylindrical tube shield 56, includes external connection pins 62 conventionally arranged as a ring and a shielded connector plug 64 which enables electrical connections to a heater 66, indirectly heated cathode 68, control grid 70 and focus grid 72 disposed within the electron gun assembly 60.

Cables 74 extend from the plug 64 through an edge-notch in the plate 53 to appropriate electronic circuitry of the source 10, explained hereinafter in conjunction with FIGS. 5, 6 and 7. A sealed evacuation nipple 78 enables conventional evacuation of gas molecules from the interior of the x-ray tube 44 during the manufacturing process.

Figure 3:
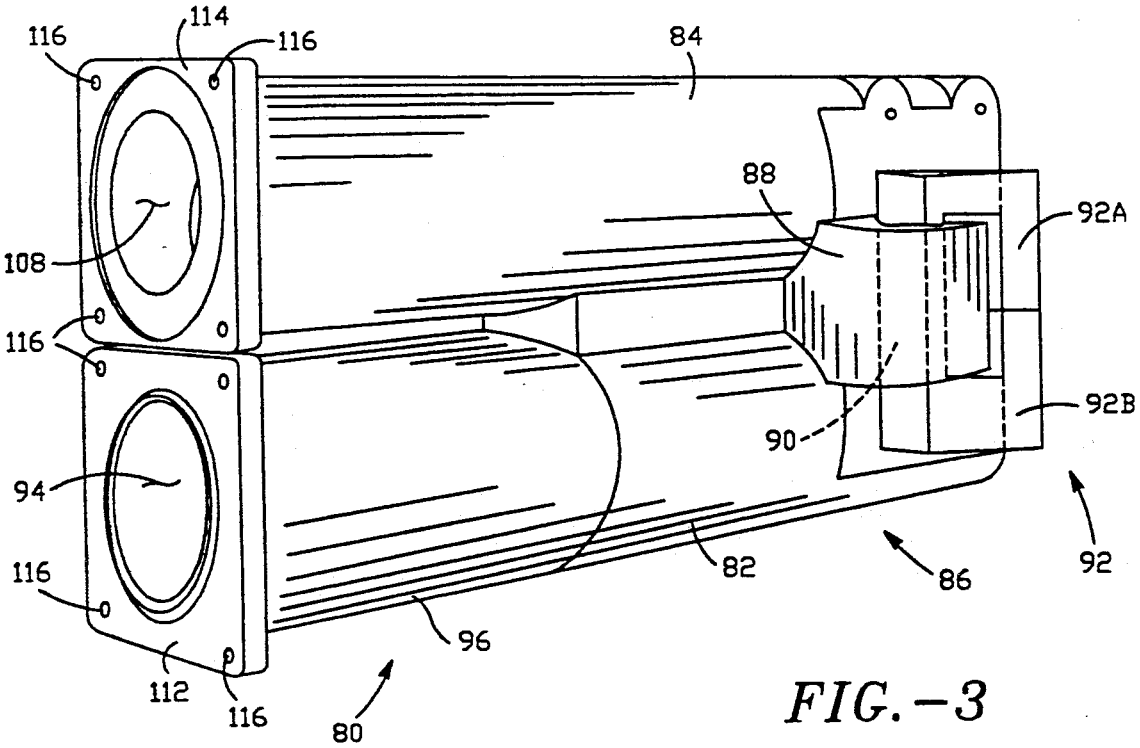
FIG. 3 is a perspective view of the molded high voltage generator block of the source depicted in FIG. 1.
Figure 4:
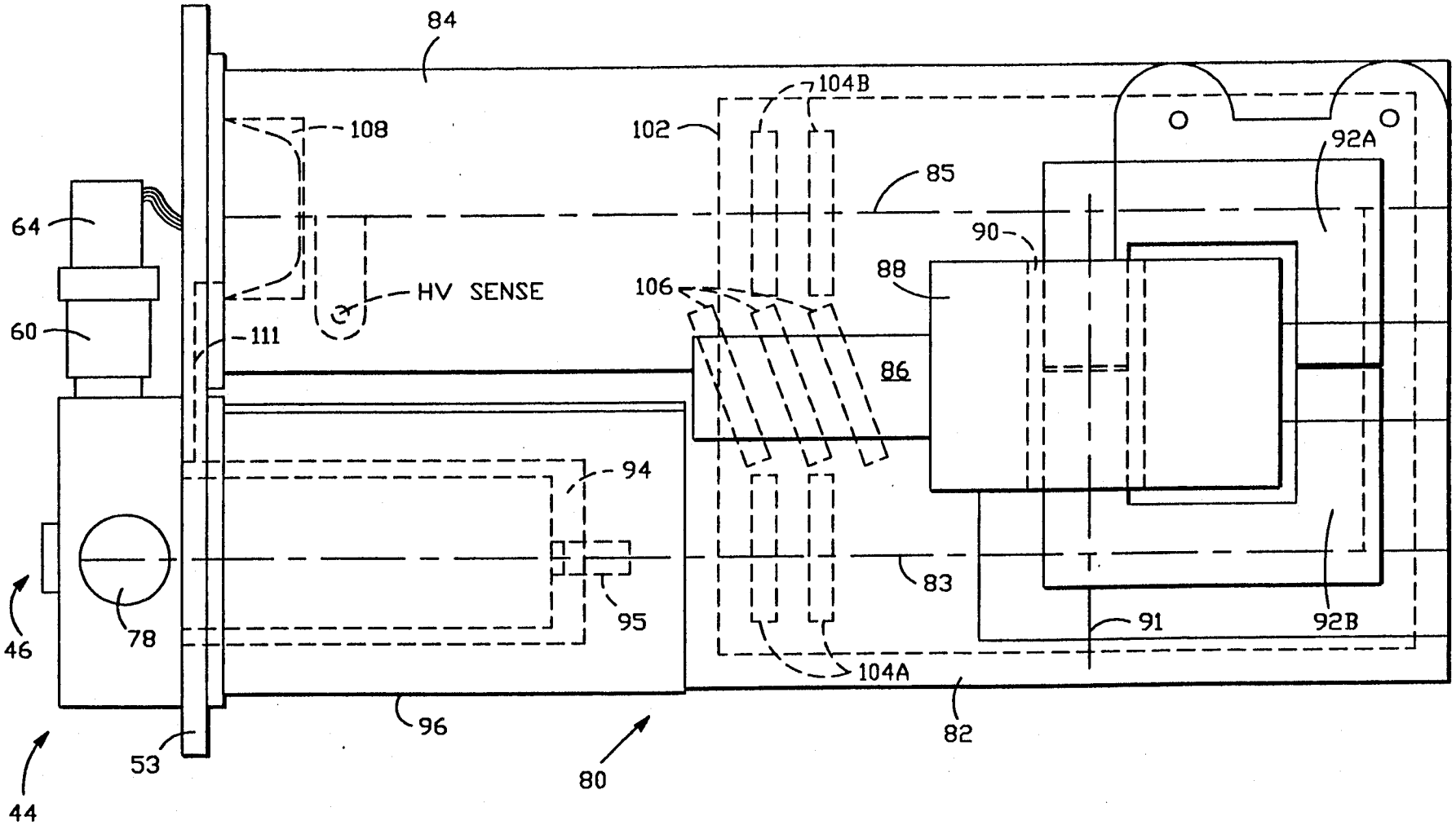
FIG. 4 is a diagrammatic transformer-side view in elevation and illustrative partial section of the molded block depicted in FIG. 3, together with related components.

As shown in FIGS. 3 and 4, centrally located within the housing 12 along a longitudinal axis is a unitary, vacuum molded elongated high voltage block 80 which includes two forwardly-extending cylindrical portions 82 and 84 and a rearward bridging portion 86. The block 80 is generally U-shaped. The cylindrical portion 82 has a longitudinal axis 83, as depicted by broken line in FIG. 4. The block 80 integrally encases and includes primary and secondary annular windings of a transformer region 88 at the rear portion of the block 80. The transformer region 88 defines a central opening 90, through the primary and secondary windings transversely with respect to the longitudinal axis of the block 80. The opening 90, having a transverse central axis 91 depicted by broken line in FIG. 4, is provided to receive a suitable ferrite transformer core 92 therethrough. A two-part U-shaped core assembly, comprising portions 92A and 92B, provides a practical implementation for the core 92.

The cylindrical portion 82 defines a tube well 94 for the x-ray tube 44 which terminates inwardly at a high voltage anode connection 95. A cylindrical shield 96, e.g. formed of lead sheet, surrounds the block 80 in the vicinity of the tube well 94. Shielding of other portions of the block may be desired or required, depending upon the design and placement of the x-ray tube and any leakage of x-rays from the tube well 94.

A two part Cockcroft-Walton capacitor-diode voltage multiplier stack assembly 100 is embedded in the rearward bridging portion 86 of the block 80. The stack assembly 100 is preferably formed on a glass reinforced resin perf-board substrate card 102 and comprises two rows of cylindrical high voltage ceramic capacitors 104A and 104B, the row 104A being embedded in the cylindrical portion 82 and the row 104B being embedded in the cylindrical portion 84, as shown in diagrammatic broken line outline in FIG. 4. Each row includes e.g. ten capacitors. A row of high breakdown voltage, high current, fast recovery silicon diodes 106 is embedded in the bridging portion 86 of the block 80. Only a few of the capacitors 104 and diode 106 attached to the card 102 are illustrated in FIG. 4, so as not to clutter unduly the drawing, it being understood that the diode/capacitor rows extend substantially throughout the longitudinal dimension of the card 102.

The stack 100 has center nodes thereof connected to the secondary winding and has a positive node connectable to the anode 58 and a negative node connectable to ground. The high voltage circuitry of the source 10 is depicted in, and discussed hereinafter in conjunction with, FIG. 7. The multiplier stack 100 contains a sufficient number of voltage multiplier stages so as to provide the desired maximum high voltage of 70 kilovolts.

A much shallower well 108 is formed in the cylindrical portion 84 of the molded block 80. This well 108 contains a bladder reservoir 110 for accomodating thermal expansion of insulating oil between the tube 44 and the tube well 94, in a manner more fully explained in conjunction with FIG. 6 of the referenced, commonly owned U.S. Pat. No. 4,694,480. A kilovoltage sense resistor stack, of the type illustrated and discussed in connection with the stack 80 in FIG. 6 of the referenced U.S. Pat. No. 4,694,480 is located in the cylindrical portion 84 immediately behind the well 108.

Two square metal mounting flanges 112 and 114, respectively embedded in the portions 82 and 84 of the block 80, enable the block 80 to be mounted in a fluid sealing engagement to the front end panel 53, e.g. by screws passing through openings 116 in the corners of the flanges. Suitable sealing gaskets may be interposed between the flanges 112 and 114 and the front end panel 53. The front end mounting plate 53 provides an insulating-oil fluid conduction passage 111 between the bladder reservoir 110 and the tube well 94, so that insulating oil in the tube well 94 may expand into the reservoir 110 as the tube 44 heats up during use.

The block 80 includes suitable screw terminals embedded therein in order to facilitate electrical connections to the components embedded therein and to secure the block 80 mechanically to the end panel 24 and to circuit boards carrying the control electronics contained within the source 10.

The block 80 is preferably formed of a light weight, yet highly insulative "micro-glass balloon-filled" epoxy resin.

Overview of Pulse Control Circuitry of Source 10

Figure 5:
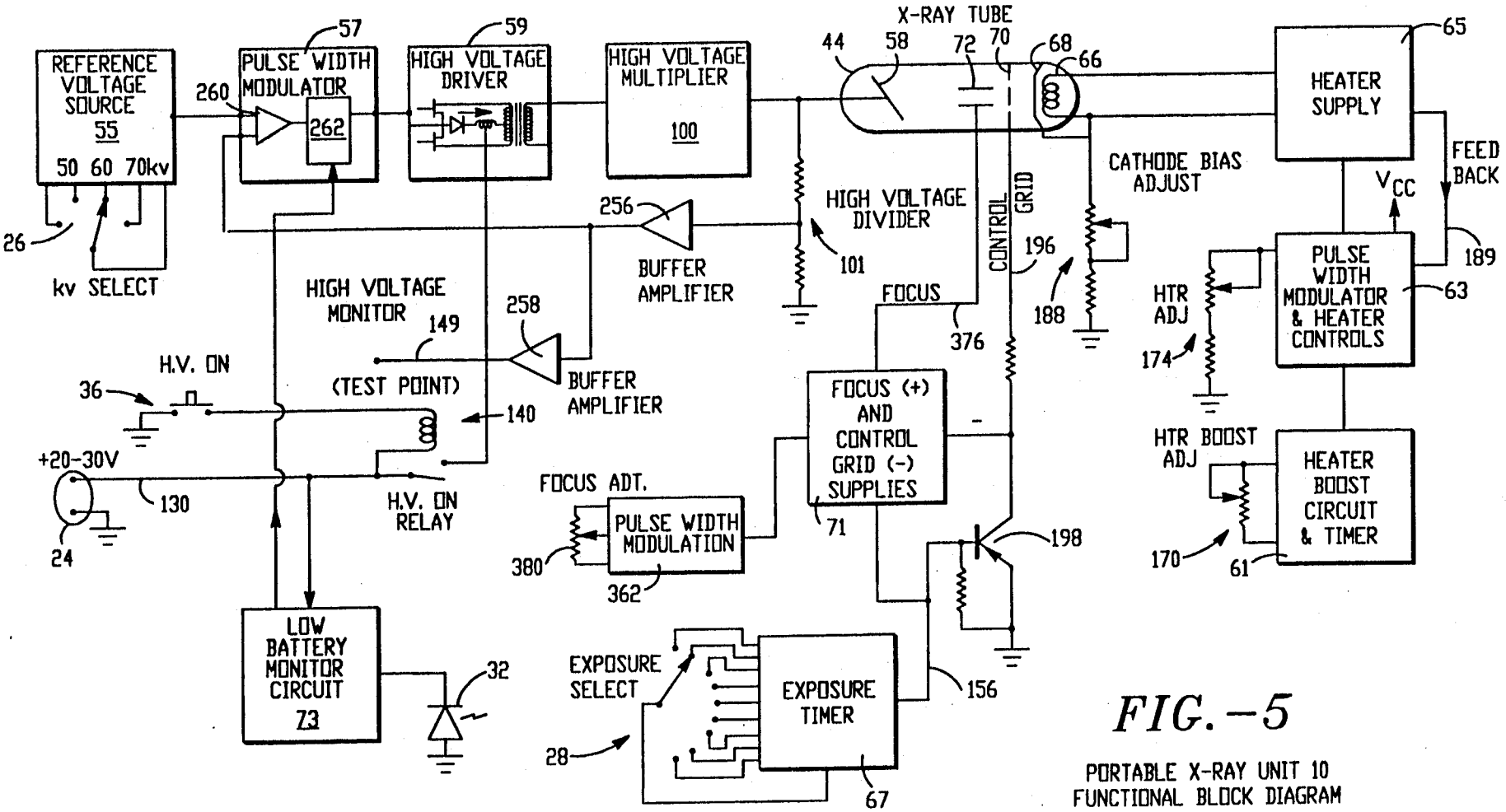
FIG. 5 comprises a simplified electrical block diagram of the x-ray source depicted in FIG. 1.
Figure 6:
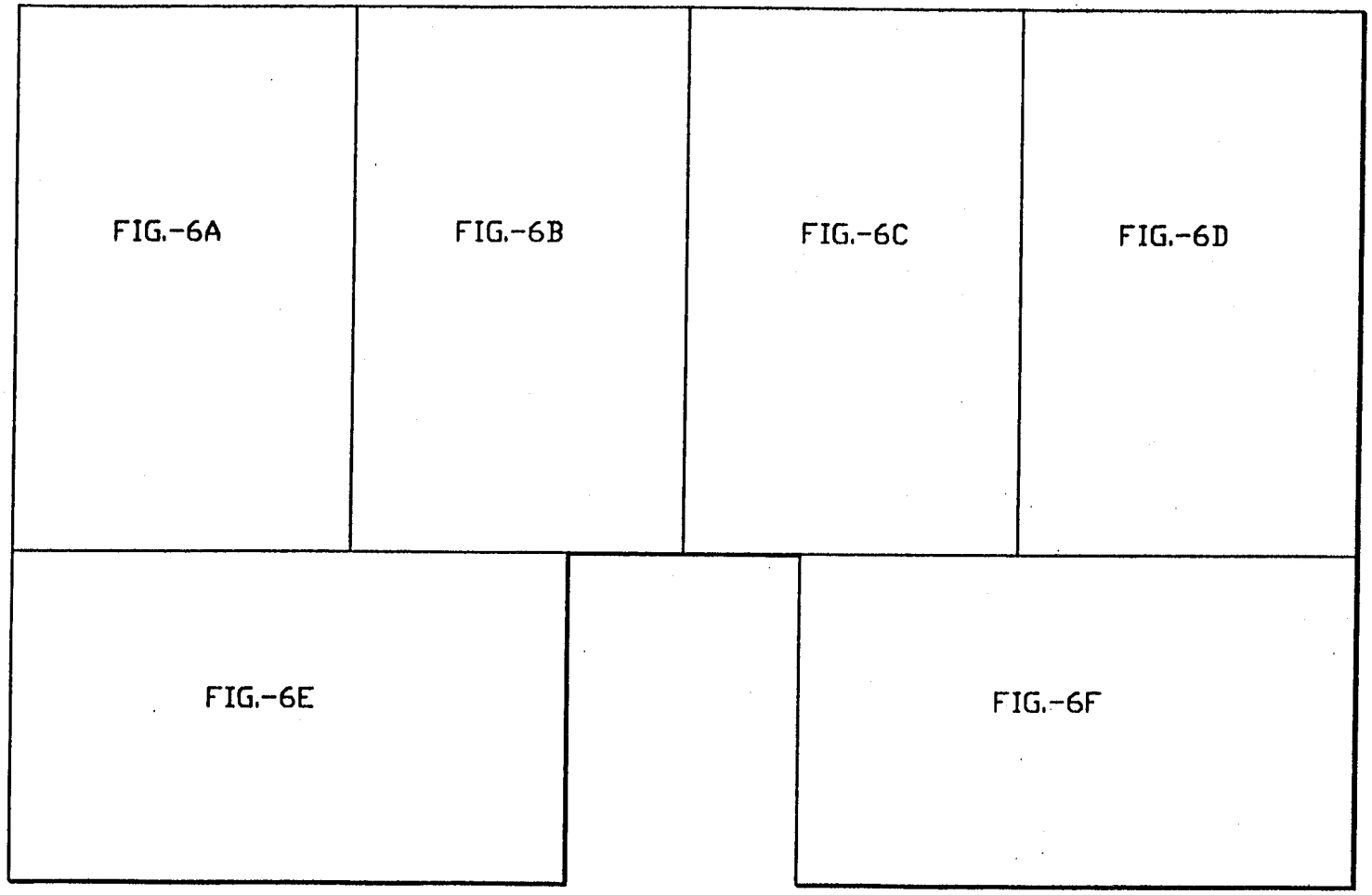
FIG. 6 comprises a layout arrangement plan for FIGS. 6A,6B,6C,6D,6E and 6F.

With reference to the FIG. 5 block diagram, primary power enters the source 10 via the cable 22. A positive node 130 receives low voltage direct current, nominally +28 volts DC from a battery supply or other source of power (not shown), and a negative node is ground throughout the circuitry extending throughout the source 10. A +15 volt regulator circuit drops and regulates the incoming voltage to +15 volts to provide a regulated power supply to other circuit elements as indicated on FIGS. 5, 6 and 7. Plus and minus 5 volt regulator circuits are also included within the source 10 to provide the circuitry with voltages needed for operation of the logical circuits. When +28 volts is connected to the source 10, the power indicator LED 30 located on the top panel becomes illuminated. While +28 volts is the nominal supply voltage, the source 10 is designed to operate over a range from 20 to 30 volts.

A reference voltage source 55 provides a reference voltage which is used to control operation of the high voltage multiplier, thereby to set the kilovoltage output thereof between e.g. 50 kV, 60 kV and 70 kV. A conditioning mode is also selectable by the kilovoltage select switch 26 included within the source 55. The high voltage divider resistance stack 101 provides a sample of the actual high voltage put out by the high voltage multiplier 100. A buffer 256 buffers this high voltage analog and feeds it to an error amplifier 260 within a pulse width modulator circuit 57. The amplifier 260 compares the actual voltage analog from the buffer 256 with the reference voltage level supplied from the source 55. The output of the amplifier controls pulse width of a pulse-width-modulator 262 within the circuit 57. The circuit 57 drives a high voltage driver circuit 59 which supplies a switching signal at approximately 20 KHz to the Cockcroft-Walton high voltage multiplier stack 100. High voltage is generated only during a control sequence during which the KV switch 36 is depressed and a high voltage relay 140 is energized and supplying primary current to the high voltage driver circuit 59. Positive high voltage from the multiplier 100 is supplied to the anode or target 58 of the x-ray tube 44.

A heater boost circuit and timer 61 provides additional heater voltage during an initial heater warm-up phase. A heater boost adjustment control 170 enables the boost voltage to be set. A heater pulse width modulator circuit 63 establishes the heater current at a precise level set by a heater adjustment control. A feedback path 189 assures that actual heater voltage is maintained at its precise level. A heater supply circuit 65 generates the power needed to supply the heater element 66 of the x-ray tube 44. An indirectly heated cathode 68 includes a cathode bias resistor network 188 which provides cathode bias operation for the tube 44. The resistor network 188 establishes a positive voltage in a range between e.g. 3 and 15 volts at the cathode with respect to ground potential and provides beam current autoregulation when the electron beam in the tube 44 is gated on by operation of the grid element 70 and the focus electrodes 72.

An exposure timer circuit 67 generates one of a number of available x-ray pulse intervals, as set by the interval switch 28 and puts out the interval over a pulse path 156. The pulse on the path 156 closes a grid control transistor switch 198 which grounds the grid, thereby permitting beam current to flow toward the target 58 during the duration of the timed interval.

A focus pulse width modulator circuit 362 generates a switching signal which is supplied to a focus electrode control supply and grid supply 71. The duty cycle of the circuit 362 is established by a focus voltage control 380. The supply 71 generates a positive focus electrode voltage of approximately +300 volts and a negative grid voltage of −50 volts, for example. Whenever the source 10 is not operating during a pulse interval, the negative grid voltage is applied to both the grid electrode 70 and to the focus electrode 72, so that the electron beam is completely pinched off.

A low battery monitor circuit 73 monitors battery voltage and generates a visual alarm at the low battery LED 32 and locks out operation of the source unit 10 whenever the primary supply voltage drops below 20 volts, for example. In order to reset the source unit 10, it is shut off and primary supply voltage above 20 volts is then applied. This power-on-reset procedure resets the lock out circuit and enables the unit 10 to operate.

Detailed Description of Source 10 Circuitry

Figure 6A:
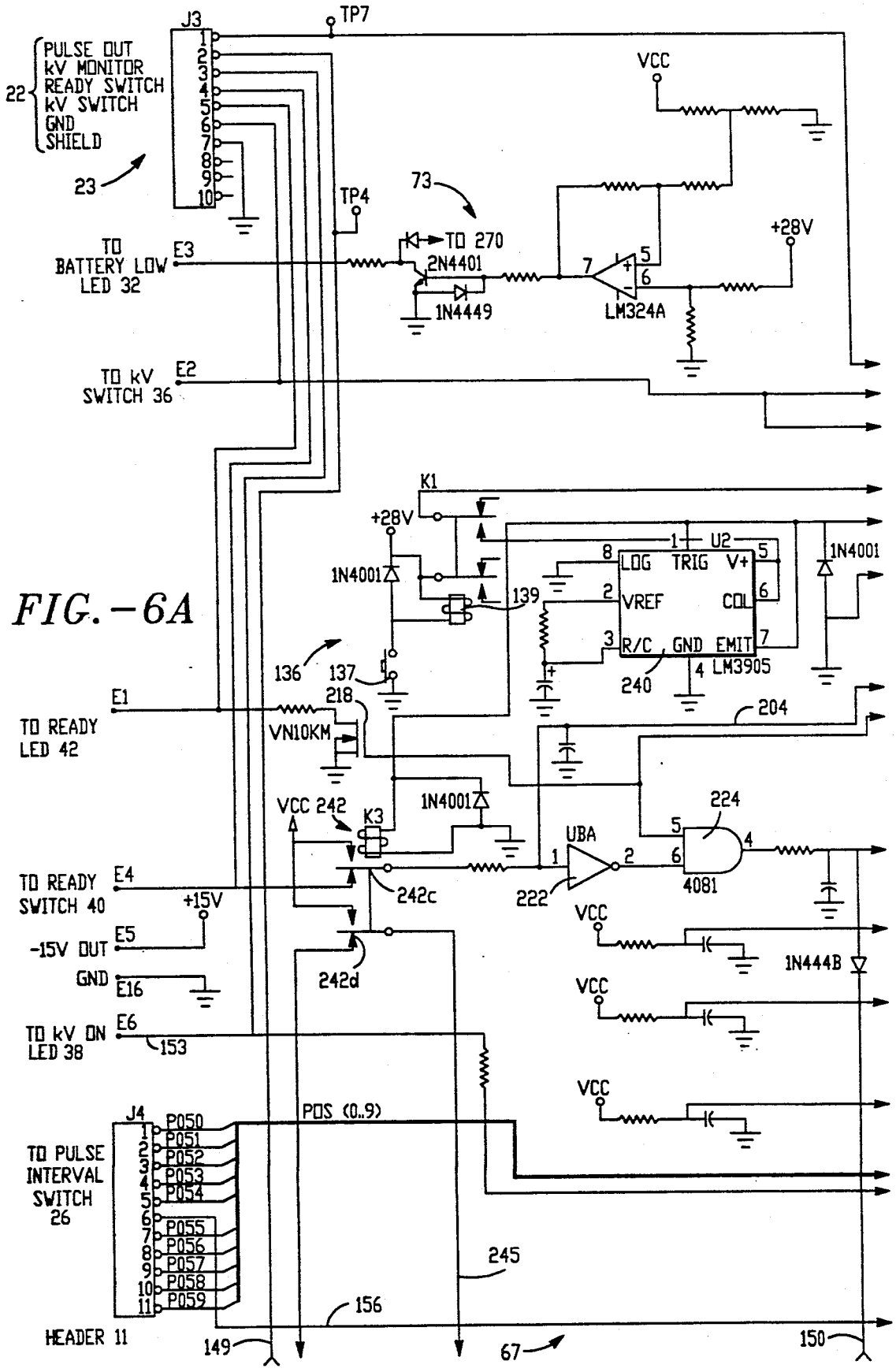
FIGS. 6A, 6B, and 6C together provide a single schematic diagram of a portion of the electronic control circuitry for controlling operation of the source depicted in FIG. 1.
Figure 6B:
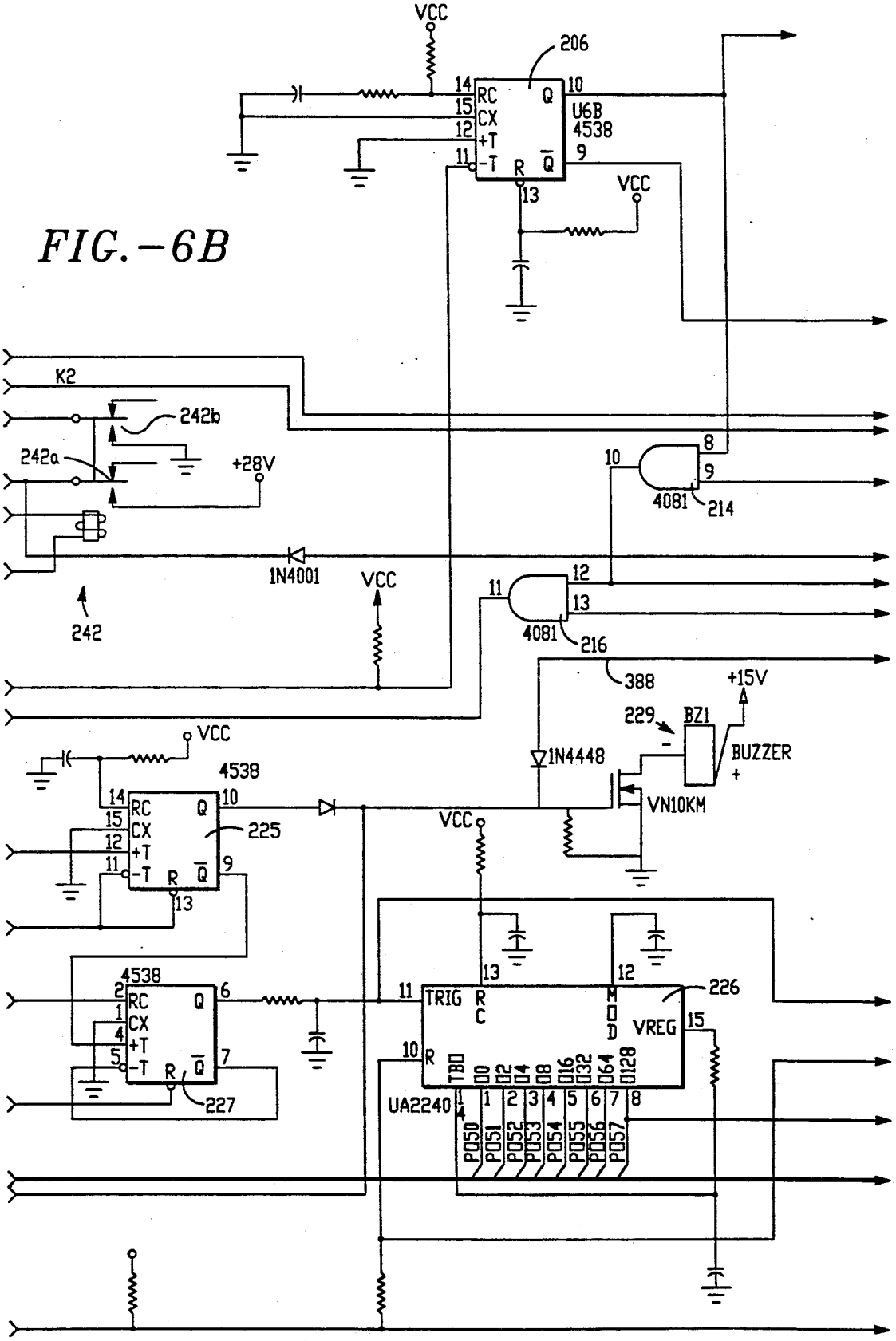

With reference to FIG. 6A and 6B, a condition mode receptacle interlock relay circuit 136 provides a conditioning mode for the x-ray tube 44. When a lead shield (not shown) is installed over the window of the x-ray tube 44 which effectively absorbs any x-rays resulting during the conditioning process, switch 137 closes. When the KV select switch 26 is set to conditioning mode and the lead shield is in place, a conditioning relay 139 is thereby activated and a tube conditioning mode of operation of the source 10 ensues.

With the condition interlock closed and the switch 26 set to condition, when the kV 36 switch is pressed, it applies power to start a timer 240 which energizes two parallel relays 242 and 242' which in turn cause the high voltage relay 140 (FIG. 7A) to be energized until the timer 240 times out. During the interval set by the timer 240, a voltage ramp is applied to the anode 58 of the x-ray tube.

Figure 6C:
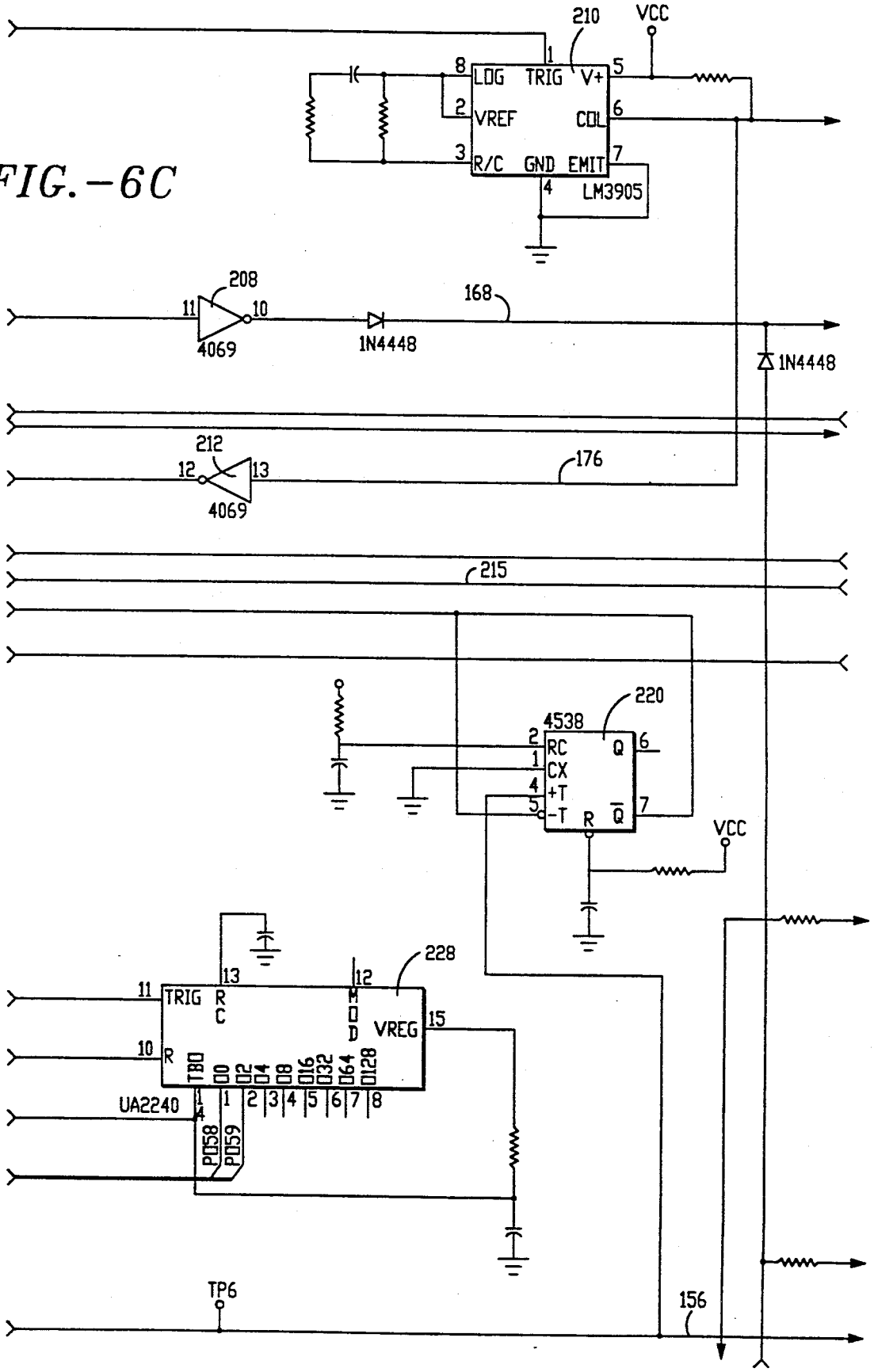
Figure 6D:
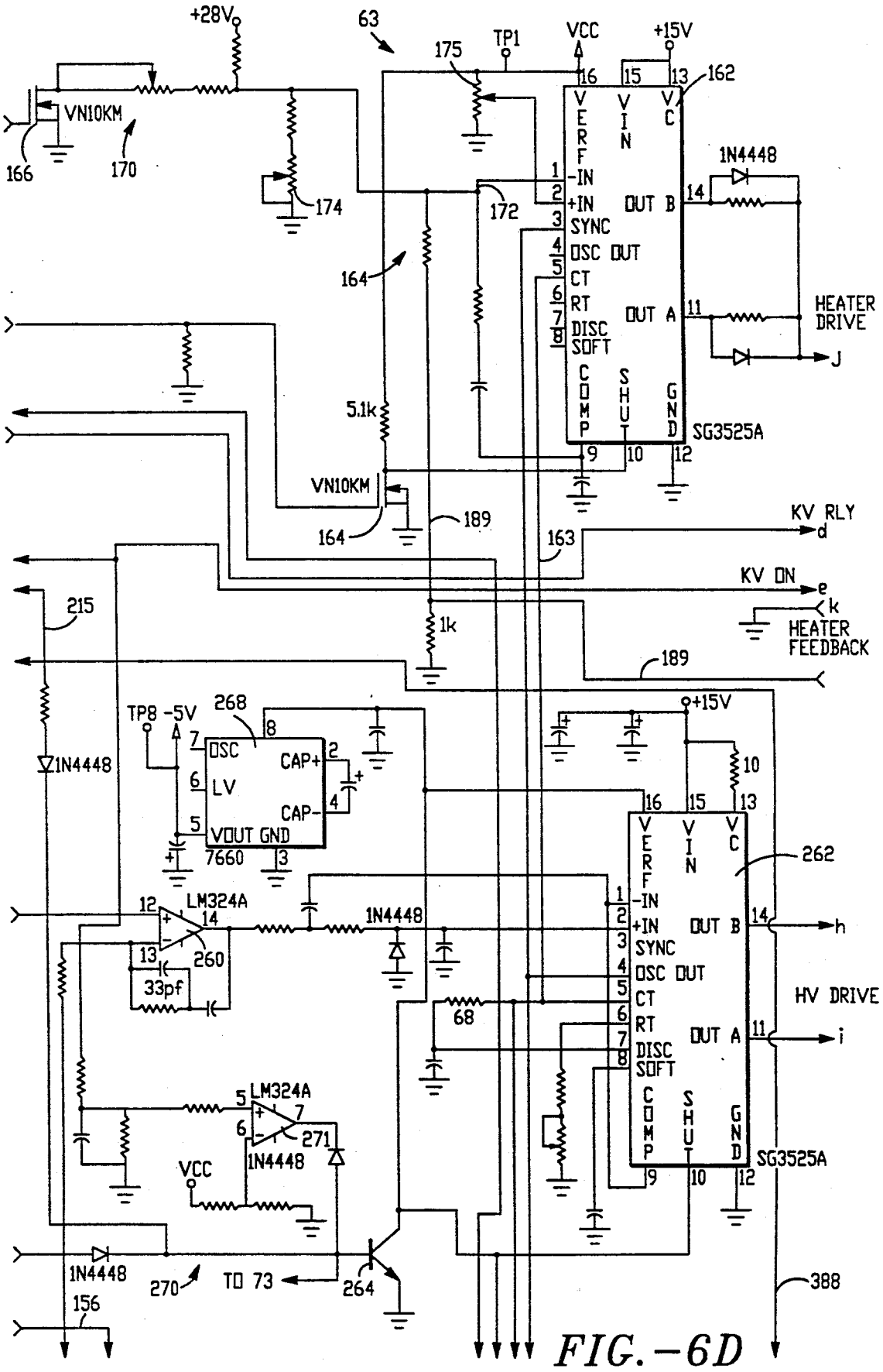
Figure 6E:
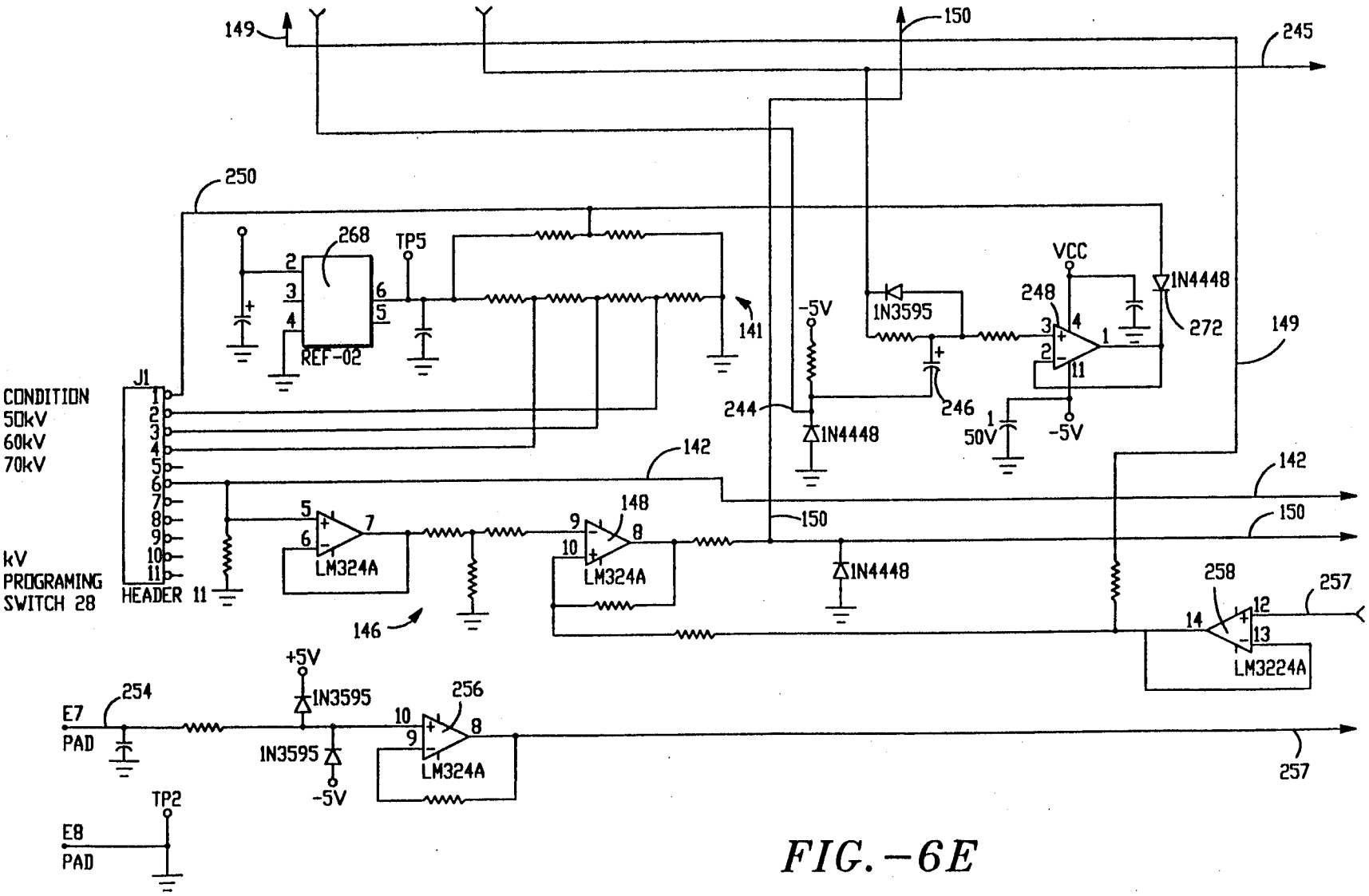

The kilovoltage switch 26 selects between normal operating mode and conditioning mode, and enables user programming at the source 10 of 50 KV, 60 KV or 70 KV, as established by selecting appropriate connections to a voltage divider resistor network 141 shown in FIG. 6E. The network 141 is connected to a 5 volt reference supplied by a reference supply 268.

The voltage value on the programming line 142 which is connected in common with the wiper line 142 of switch 26 passes through an op amp 144 connected as a buffer to a 1 k/9 k voltage divider network 146 at an inverting input of an op amp 148 connected as a comparator. The non-inverting input to the comparator 148 is provided from the kv monitor line 254 connected to the high voltage series resistance stack 101 encapsulated in the block 80 and electrically connected to the tube anode connector 95 in the x-ray tube well 94. When the monitored actual kilovoltage value at the anode 58 of the x-ray tube reaches ninety percent of the KV value preset at the switch 26, an output line 150 of the comparator 148 becomes true.

Figure 6F:
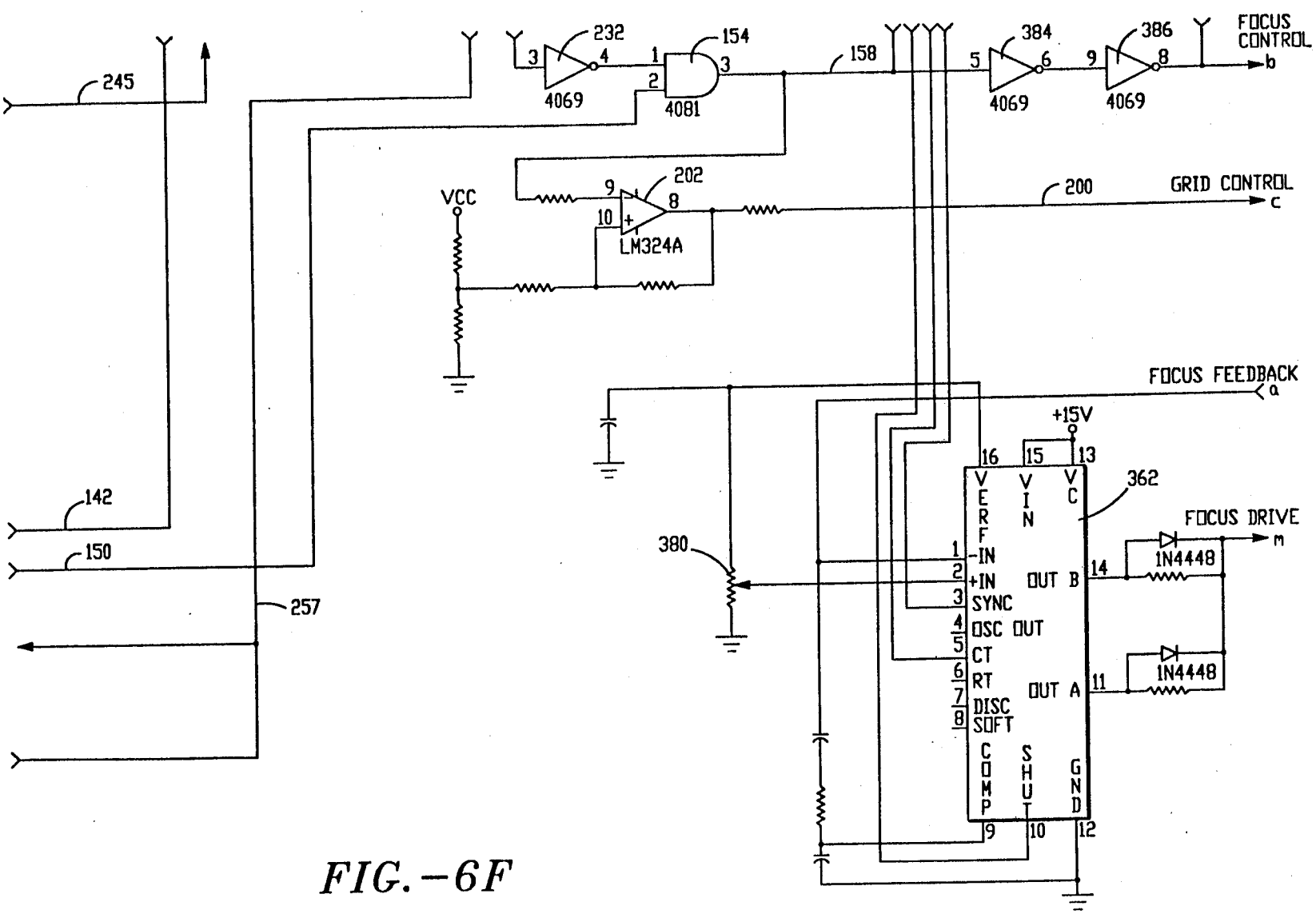

Referring now to FIGS. 6A and 6B, when the line 150 is true or logically high, a timer 225 is enabled. The timer 225 starts a timing interval whenever the two inputs of the AND gate 224 are true. During the timing interval, the "KV" indicator LED 38 is powered by a line 153 and becomes illuminated. The line 150 also enables one input of a two-input pulse interval AND gate 154 (FIG. 6F). The other input of the pulse interval AND gate is from an inverter 232 within a line 156 leading from the pulse interval timing circuit 67 to be described in greater detail hereinafter.

During the conditioning mode, while high voltage and heater voltage are applied to the x-ray tube 44, the grid and focus electrodes are biased at a negative voltage to keep the x-ray tube 44 biased off. The relay contacts 242C prevent the unit 10 from being pulsed on when it is operating within the conditioning mode. The function of the conditioning mode is to purge the interior thereof of gaseous ions leading to voltage breakdowns and catastrophic failures therein.

The AND gate 154 has an output line 158 which goes true for a programmable x-ray pulse interval during which the source 10 will generate and put out x-ray energy. The line 158 is enabled only after the heater 68 has reached operating temperature. In response to the true level on the line 158, focus and grid voltages are presented on the focus and grid electrodes 72 and 70 respectively. The line 158 is not enabled during the conditioning mode. Beam control of the x-ray tube 44 will now be explained.

As shown in FIG. 6D, the heater control circuit 63 includes an integrated circuit pulse-width-modulator 162 set to oscillate at a nominal frequency of 20 kilohertz. The oscillator 162 is synchronized to a pulse-width-modulator 262 driving the high voltage generator portion of the system 10. The modulator 262 also synchronizes operation of a pulse width modulator 362 (FIG. 6F) which provides drive for the focus and grid voltage supply 71. A line 163 connects a synchronization signal from the modulator 262 to synchronize the modulators 162 and 362. The oscillator 162 puts out a reference +5 volts which is supplied as Vcc to the logic circuits of the source 10.

The heater control circuit 63 includes two FET switches 164 and 166 (FIG. 6D). The FET switch 164 turns the heater modulator 162 on and off in accordance with a time-out control signal on a time out control line 168 (FIG. 6C). The FET switch 166 shunts a first variable resistance network 170 across a duty cycle control node 172 of the modulator 162 having a second variable resistance network 174 to ground. The FET switch 166 operates in accordance with a heater boost control signal on a line 176. When the FET switch 166 is closed the duty cycle of the modulator 162 is substantially increased, so that during an initial heater warm up interval lasting about 5 seconds, about ten volts of heater voltage is supplied to the tube heater 66. After the five second rapid warm up period, the FET switch 166 opens, and the tube heater voltage drops to its normal operating potential, about five volts, as set by the variable resistor 174 also attached across the duty cycle control node 172. Heater voltage range is established by a potentiometer 175 connected to the modulator 162.

Figure 7A:
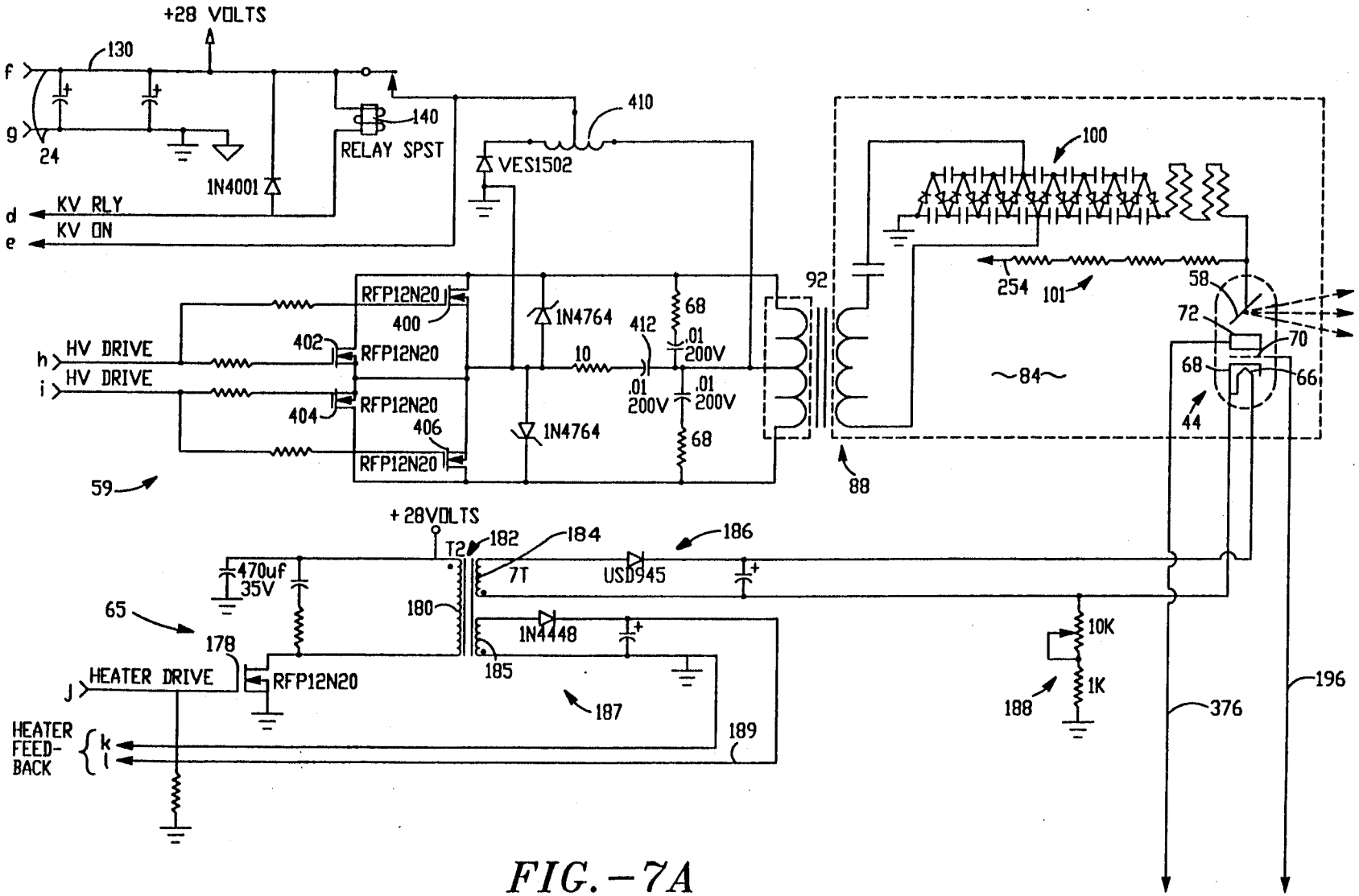
FIGS 7A and 7B are a schematic circuit and block diagram of a high voltage generator, heater, focus element and grid power supply within the source depicted in FIG. 1.

The modulator 162 drives the heater supply 65 which includes a power FET amplifier 178 which is coupled to a primary winding 180 of a heater power transformer 182 (FIG. 7A). A heater power secondary winding 184 indirectly receives heater power from the transformer 182. A half wave power supply 186 comprising a diode and a capacitor provides smoothed direct current to the tube heater 66 in order to extend the useful life thereof.

A feedback winding 185 and feedback control voltage network 187 generate a DC feedback voltage which is fed back over a feedback line 189 to the input node 172 of the heater modulator 162 in order to ensure regulation of the pulse width modulator 162 (FIG. 6D). It is an important aspect of the present invention that heater current (and resultant heater temperature) be precisely controlled so that there is no unwanted migration of cathode material from the cathode 68 to the grid and focus control elements 70 and 72. The feedback circuit 187 and its DC feedback voltage function to provide this wanted regulation of heater current.

The focus drive circuit 71 (FIG. 7B) includes a FET drive amplifier 366 which connects to a primary winding 368 of a focus voltage transformer 370. A secondary winding 372 connects to a voltage multiplier stack 374 which produces a suitable control voltage of approximately +200 to +300 volts which is applied over a line 376 to the focus elements 72 to focus the electron beam of the x-ray tube 44. A feedback network 378 develops a focus feedback control voltage which is fed back to the focus pulse-width-modulator 362 (FIG. 6F) in order to control its duty cycle. A potentiometer 380 enables adjustment of focus drive and thereby enables control of beam spot size. A focus control transistor 382 permits a negative bias voltage to be applied to the focus electrode 72, except during the x-ray pulse interval when the transistor 382 is conducting. The base of the transistor 382 is connected to the pulse interval line 158 through two inverters 384 and 386 and the line 388. The transistor 382 turns on during the pulse interval which in turn turns on a focus drive transistor 383 which applies the positive focus voltage to the focus electrode 72 during the pulse interval.

A negative voltage grid control rectifier and filter network 194, is connected to the secondary winding 372 of the focus transformer 370. Grid control voltage of approximately minus 50 volts is sent via a line 196 to the control grid element 70 of the x-ray tube 44. The negative grid voltage is also applied to the focus electrode over the line 376, except during the x-ray pulse interval, in order to assure that the electron beam is completely pinched off at all times other than during an x-ray pulse interval.

Whenever the negative grid bias voltage on the line 196 is present, beam current in the x-ray tube 44 is effectively pinched off. A transistor switch 198 shunts the line 196 up to ground potential during each x-ray pulse interval. A negative voltage on a line 200 connected to the base of the transistor 198 causes it to conduct and thereby shunt the line 196 to ground, thereby fixing grid potential at the x-ray tube 44 at approximately ground and the cathode potential slightly positive with respect to ground by virtue of the cathode bias resistor network 188 (FIG. 7A).

The grid control line 200 is negative when an op amp 202 configured as a comparator detects the occurrence of the beam pulse interval control signal on the line 158 leading from the pulse interval AND gate 154 (FIG. 6F).

Figure 7B:
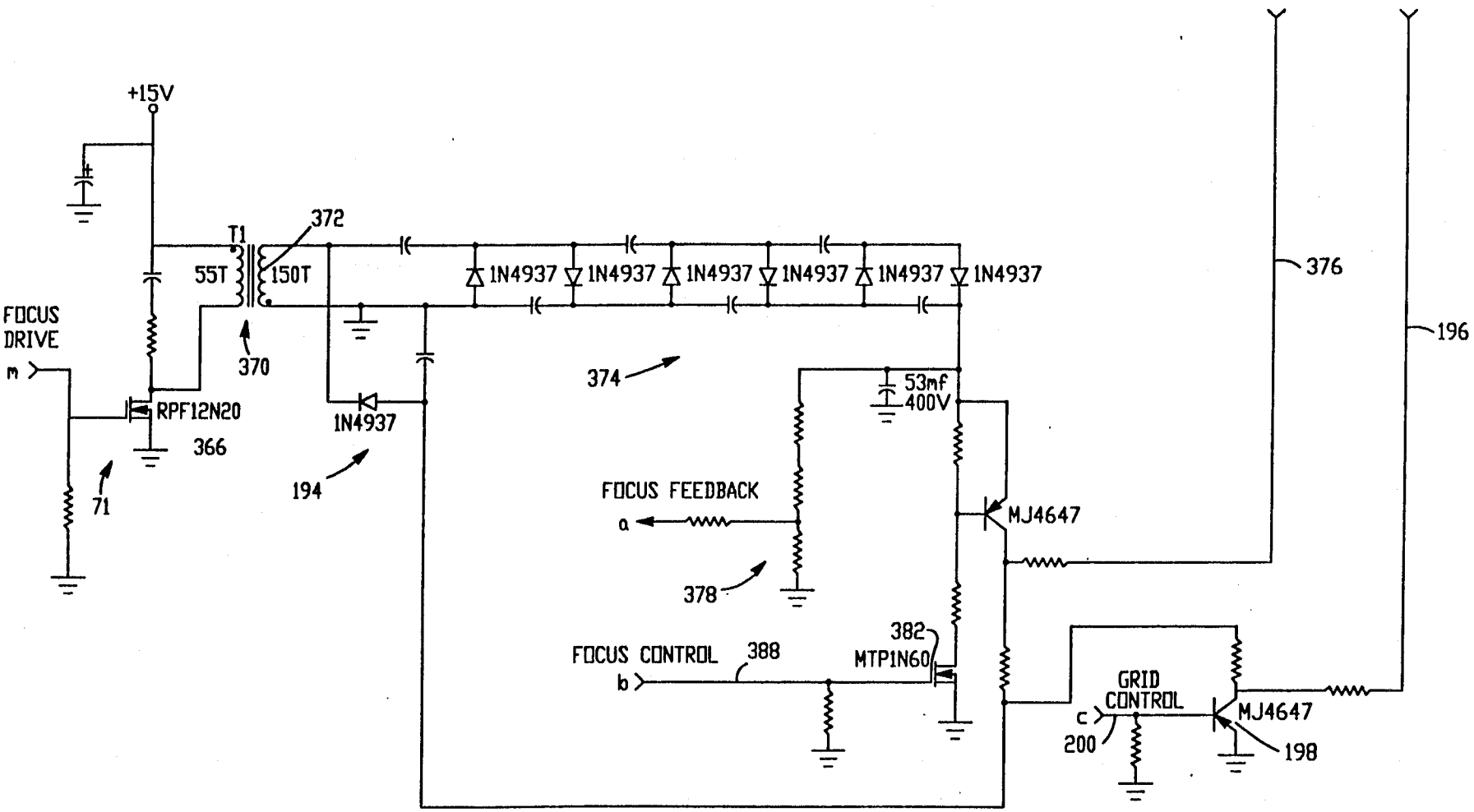

The x-ray tube 44 employs cathode bias regulation by virtue of an adjustable series resistor network 188 between the cathode element 68 and ground (FIG. 7A). Since electron current flows from the cathode 68 at ground potential to the highly positive anode element 58, a voltage drop occurs across the resistor 188. This voltage drop places a minimum negative voltage on the grid element 70 when the transistor 198 shunts the grid 70 to ground (FIG. 7B). There is no voltage drop across the resistor 188 when the grid is biased off, since the current is zero. The voltage drop across the resistor 188 during beam current pulse intervals is added to the negative grid bias voltage on the line 196 when the transistor 198 is conducting. The cathode resistor method of biasing is self regulating, since if x-ray tube characteristics vary slightly from tube to tube or over the useful life of a given tube, the bias voltage will increase if the beam current is slightly high, or it will decrease if the beam current is slightly low. This auto-regulation tends to stabilize and hold the beam current constant.

Returning to FIGS. 6A,6B,6C,6D and 6F, the exposure timer circuit 67 will now be explained. When the beam control or "ready" switch 40 is initially depressed, a low logic level is generated, and this low level is sent through a relay contact pair 242c and a line 204 to an inverting, triggered input of a time out timer 206 which thereupon counts a time interval of e.g. 60 seconds. When a time out interval begins, the outputs of the timer 206 are enabled. After the time out interval has elapsed, the timer 206 outputs change state and the logical level on the time out line 168 goes low. When the time out line 168 goes low, the modulators 162, 262 and 362 are shut off. Each trigger signal received by the timer 206 restarts its internal time-out clocking process.

An inverted output from the timer 206, is inverted by an inverter 208 and is sent via the line 168 to turn on the FET switch 164 which in turn enables the heater pulse-width-modulator 162 thereby to begin the heater warm up cycle.

A non-inverting output from the time-out timer 206 triggers the heater boost circuit 61 which includes a timer 210 (FIG. 6C) which times a heater voltage boost interval of e.g. five seconds. The logic output from the heater boost timer 210 is supplied via the line 176 to control the heater boost FET switch 166 (FIG. 6D), and thereby to increase the duty cycle of the modulator 162 and resultant heater voltage during an initial 5 second heater voltage boost interval. The function of the time out timer 206 is to turn the unit 10 off if it has not been triggered for the preset timeout interval, e.g. 60 seconds. The time out timer 206 is retriggered after each x-ray pulse interval which thereby extends the preset timeout interval. Since the heater boost timer is triggered when the output of the timer 206 changes state initially, each retriggering of the timeout timer 206 does not change its output state and does not retrigger the heater timer 210 to be sure that the heater voltage boost circuit 61 is operated only once during the time out interval, so that the heater element 66 of the tube 44 is not overheated, with consequent liberation and migration of cathodic material to other structures within the envelope of the tube 44.

The heater boost enable signal on the line 176 is fed back through an inverter 212 to one input of an AND gate 214. The other input to the AND gate 214 is the non-inverted output of the timer 206. A "ready to pulse" output from the AND gate 214 becomes true during an interval when the five second boost interval timed by the timer 210 has elapsed and the time-out timer 206 has not yet timed out.

The "ready to pulse" output is supplied on a line 215 to one input of an AND gate 216. The output of the AND gate 216 controls a gate of a FET switch 218 which turns on the "ready" indicator LED 42. The other input to the AND gate 216 is supplied from a duty cycle timer 220 which is set to limit the duty cycle frequency of the x-ray tube 44 to e.g. no more than one pulse interval in each 20 seconds, for example.

Precise pulse interval control provided by the pulse timer circuit 67 will now be described (FIGS. 6A and 6B). When the beam current control switch 40 is depressed after the "ready" lamp 42 is illuminated, the resultant logical low signal is inverted by an inverter 222 and supplied as one input to an AND gate 224, the other input of which being supplied from the "ready" output of the AND gate 216. The output from the AND gate 224 enables two series-connected timer chips 225 and 227. Timer chip 225 generates a pulse of a duration e.g. one half second which turns on the "beam on" indicator and buzzer 229. The purpose of the timer 225 is always to turn the buzzer 229 on for at least one half second irrespective of a shorter x-ray pulse interval in order to assure that an audible warning will be emitted by the buzzer 229 during the x-ray pulse interval. The output of the timer 225 also triggers timer 227. The non-inverting output from the timer 227 triggers two counters 226 and 228 (FIG. 6C) having selectable outputs, each representing a different counting interval.

The counter chips 226 and 228 are connected to provide one of ten presettable pulse intervals, e.g. from 2 milliseconds to 1 second ($2\ \text{msec} \times 2^{10}$) in accordance with the setting of the exposure interval thumbswitch 26. The x-ray pulse duration output line 156 from the wiper of the switch 26 carries a logical low pulse interval control signal which is supplied to a non-inverting trigger input of the duty cycle timer 220 (the rising edge at the end of the pulse interval restarts the duty cycle timer 220). This logical low interval signal is also passed through an inverter 232 (FIG. 6F) to the AND gate 154 which provides the x-ray control pulse over the pulse control line 158 to control operation of the grid switch transistor 198 (FIG. 7B) and focus control transistor 382, as already explained.

The inverting output of the timer 225 triggers the input of the timer 227 which triggers the inputs of the counters 226 and 228 (FIGS. 6B and 6C).

A warning buzzer circuit 229 is connected to the non-inverting output of the timer 225 which turns on the buzzer. At the end of the period timed by the timer 225, the timer 227 is triggered which in turn triggers timers 226 and 228. The output of the timers 226 and 228 is fed through an inverter 232 to an AND gate 154, through inverters 384 and 386 to a line 388 which is the focus control line. The line 388 (FIG. 7B) is connected to the buzzer circuit 229 (FIG. 6B). Therefore, pressing the exposure button 40 turns on the timer 225 for one half second, during which the buzzer is sounding. At the end of the interval timed by the circuit 225, the timer 227 turns on which in turn triggers the timers 226 and 228 which continue the buzzer to sound for the preset x-ray exposure pulse interval. Thus, the buzzer circuit 229 is providing an audible alarm during an initial half second interval and continues sounding the alarm during the actual exposure interval, which may be as long as one second, for example. The buzzer sound emanating from the unit 10 provides a warning sound to personnel in the vicinity thereof that an x-ray pulse interval is occurring. At the same time, the BEAM ON LED 38 becomes illuminated (FIG. 6A).

After the selected x-ray pulse interval has elapsed, the falling edge thereof resets each of the counters 226 and 228 to zero, so that they may repeat their counting intervals during the next x-ray pulse generation sequence.

Conditioning Circuit

As already mentioned, a conditioning function has been provided within the source 10. This function may be carried out periodically, after extended periods of disuse to ensure that the x-ray tube will operate without electrical arc-over during conditions when high voltage is present.

When the source 10 is properly fitted with a lead shield and preferably installed within a shielded conditioning container, and when the KV select switch 26 is set to the conditioning mode, the relay 139 is activated. When the KV push button 36 is depressed, +28, volts is supplied to a conditioning timer 240 (FIG. 6A). This momentary application of +28 volts causes a relay coil 242 to be energized and to apply +28 volts to the timer 240 for the duration of the timing interval, by virtue of a contact set 242A (FIG. 6B). At the same time, the KV relay 140 is energized by virtue of a return connection to ground through contact set 242B.

The timer 240 is set to time an interval of about 3 minutes. During that time, high voltage is applied to the tube 44, and the heater supply is operating, but the grid and focus electrode supplies are not enabled, by virtue of the contact set 242C which inhibits the timer sequences otherwise initiated by the beam current control push button switch 40. This safeguard insures that the source 10 cannot be caused to generate x-rays during the conditioning process.

Finally, a contact set 242D applies a +5 volt charging voltage across a ramp generator circuit 244 (FIG. 6E) which is connected to the kilovoltage programming divider resistor network 141. The ramp circuit 244 causes the high voltage slowly to ramp up to the +70 kilovolts maximum during the conditioning mode, as a capacitor 246 at an input of an op amp 248 charges toward the +5 volts. When the output voltage of the op amp 248 approaches a voltage established at a node 250 of the network 141 (equalling a control voltage for commanding +70 KV), a diode 272 reverse biases and the high voltage remains at +70 KV for the remainder of the conditioning cycle.

At the end of the conditioning cycle, the relay armature coils 242 (FIGS. 6A and 6B) and 242' are deenergized, and the contact sets 242A-D return to their open or quiescent states, thereby disabling the conditioning timer 240.

High Voltage Driver Circuit 59

A kilovoltage sense voltage on a line 254 is developed across the kilovoltage sense resistance 101 located in the molded block 84. This voltage is calibrated and buffered in an op amp 256 (FIG. 6E) and then put out on a line 257. The sense voltage is further buffered in an op amp 258 and sent to the op amp 148 to provide a sense input for indicating that the sensed high voltage has reached 90% of the programmed voltage as set at the KV selection switch 28. Actual high voltage as monitored is available on a monitor line 149.

With reference to FIG. 6F, the calibrated KV sense voltage on the line 257 is subtracted from the KV programming voltage on the line 142 from the resistor network 141 (FIG. 6E) in an op amp 260 configured as an error amplifier. The op amp 260 (FIG. 6D) is connected to control pulse width of the high voltage pulse-width-modulator/driver 262. The output of the driver 262 drives four power FET transistors 400, 402, 404 and 406 within the driver circuit 59 which are connected as shown in FIG. 7A. The drains of transistors 400 and 402 are connected in parallel to one side of the primary winding of the transformer 88, while the drains of the transistors 404 and 406 are connected in parallel to the other side of the primary winding. The center tap of the primary winding of the transformer 88 is connected to a flyback inductor 410 which dumps current into a storage capacitor 412 during a flyback phase of operation of the transformer 88 so as to sustain power switching operation as is conventional with switching power supplies. The center tap of the inductor 410 is connected to the +28 volt supply line 130 through the contacts of the high voltage relay 140, and the switching return path is through the primary of the transformer 88 and the transistors 400–404 to ground.

Returning to FIG. 6D, a transistor switch 264 has its base connected to the KV shutdown line 245 from the network 244 (FIG. 6E). The switch 264 enables the high voltage driver 262 if the source unit 10 is in the ready for exposure condition or if the source 10 is operating in the conditioning mode. A precision +5 v regulator 268 supplies a +5 volt reference voltage to the reference divider 141. A switching power supply chip 268 converts +5 volts into a minus 5 volt reference in order to provide a negative rail voltage to the operational amplifiers of the control circuitry of the source 10.

A circuit 270 includes an op amp 271 connected as a comparator which has its inverting input connected to +1.5 volts and its noninverting input connected to a voltage divider made up of an 8.06 kilohm resistor and a one kilohm resistor. This voltage divider divides down the switched output from the high voltage relay 140.

Operation of the circuit 270 (FIG. 6D) is as follows: The output from the op amp 271 will be low unless the high voltage relay 140 is energized which occurs when the kV switch 36 (FIG. 6A) is pressed and the kV set switch 26A is set to the conditioning mode. A low output from the op amp 271 pulls the base of the transistor 264 low which keeps it from turning on. So long as the transistor 264 is so inhibited, the pulse width modulator 262 is also inhibited, until the kV switch 36 is pressed. This inhibition is required because in the kV off position, the error amplifier 260 has a kV program input on its non-inverting input. But, since there is no high voltage being produced, the feedback voltage on the inverting input is zero. This makes the output of the amplifier 260 command a maximum pulse width at the high voltage pulse width modulator 262.

Without the circuit 270, when the kV switch 36 was pressed, the primary power would be applied to the high voltage block which was being told to run at full pulse width (maximum duty cycle) by the amplifier 260 which would cause the high voltage to go higher than the programmed output until the negative feedback could cause the pulse width to be reduced.

Low Battery Indicator and Lockout Circuit

If the +28 volt battery voltage falls below a predetermined minimum level, as detected by a low battery indicator circuit 73 (FIG. 6A), the "battery low" LED 32 is energized to indicate to the operator that the battery voltage is below e.g. 20 volts and the source unit 10 is prevented from operating. The base of the transistor 264 (FIG. 6D) is pulled low in the circuit 270 thereby inhibiting the pulse width modulator 262 from functioning.

External Control of Source 10

As already mentioned, the cable 22 which supplies primary power to the source 10 also contains a number of control lines. These lines connect to a header 23 shown in the FIG. 6A schematic and thereby carry the pulse out signal, the high voltage monitor signal, a bridge connection for the ready switch 40, a ready LED signal, and a bridge connection for the KV switch 36. These signals and control lines enable external equipment to control and/or to be synchronized with the operation of the unit 10

Light Weight Self Shielding X-Ray Tube 44

As already noted generally above, modern x-ray imaging techniques using e.g. image intensifier and video display technology have made possible the design and use of low intensity x-ray sources, such as the integral source system 10 within x-ray imaging systems. One such imaging system for example is described in U.S. Pat. No. 4,142,101 to Yin, and facially assigned to the National Aeronautics and Space Administration (NASA). The present assignee's recent innovations in source size reduction and in modularization, as exemplified by the referenced U.S. Pat. Nos. 4,646,338 and 4,694,480, have demonstrated the feasibility of developing and producing light in weight, small sized x-ray sources. These developments in imaging displays and in x-ray source miniaturization have now made it possible to produce integrated x-ray imaging systems which are light, compact and suitable for portable use.

Many applications suggest themselves for such imaging systems including forensic and security monitoring, mobile, field and space environment medical and dental diagnosis (e.g. such systems could easily be included in ambulances and mobile life support emergency vehicles,), military and field hospitals, and industrial inspections, for example.

Conventional x-ray tubes, being isotropic x-ray energy generators, have traditionally been mounted in a housing which has been constructed of a material and designed to absorb x-ray energy emitted by the tube in all directions other than an intended (and usually quite narrow) cone of radiation. In order to absorb x-ray energies, the housing typically contains solid lead shielding. The housing is also designed to protect personnel from being exposed to the extremely high voltage potentials required to generate x-rays. The lead shielding used in these prior housings has contributed considerably to the overall weight of the x-ray table assembly and has necessarily detracted from portability of the x-ray equipment.

Figure 10:
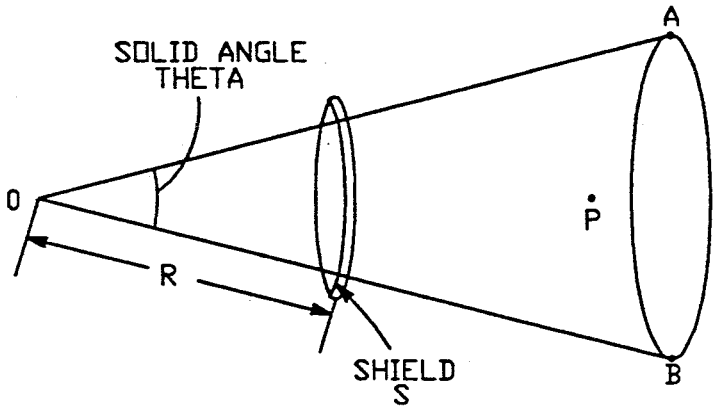
FIG. 10 is a graphic illustration of shielding principles employed in the x-ray tube used in the system of FIG. 1.

It will be understood by those skilled in the art that the weight of shield material required is proportional to the square of its distance from the x-ray source. Referring to FIG. 10, consider a source of x-rays at point 0. This source may be the location of impact of an electron beam into an x-ray tube target, such as the target 58 of the tube 44. X-rays generated at point 0 will radiate in all directions, so that the wave front is spherical. The two lines OA and OB are meant to define the limits of a portion of the total sphere of radiation emanating outward from source location 0, i.e., AOB in FIG. 10 is a two dimensional representation of a solid conical portion of the sphere, and the convex surface joining points A and B is a portion of the surface of a sphere.

Shielding of the conical section depicted in FIG. 10 is introduced at location S, so that x-ray intensity at point P, located beyond the shielding S in the depicted cone, is attenuated.

Let $I_o$=intensity of x-radiation at P with no shielding.
Let $I_s$=intensity of x-radiation at P with shielding.

Let $\left(\frac{Mu}{Rho}\right)$= x-ray mass absorption coefficient for the shielding material.

Let Rho=density of the shielding material.
Let t=Thickness of the shielding material.
Let Theta=solid angle AOB in FIG. 9.
Then $$I_s = I_o \exp - \left(\frac{Mu}{Rho}\right) Rhot$$

i.e. for shields made out of the same material, the x-ray attenuation is dependent only on thickness of the shielding material. If the shield is shaped to be a portion of a spherical surface subtending a solid angle theta at point 0, the mass of this shield will be given by:

$$\begin{aligned} m &= (\text{area of cone end}) \times t \times Rho \\ &= \text{theta } R^2 \times t \times Rho \end{aligned}$$

where R is the radius of the sphere of which the shield is a section. Theta, t and Rho are all made constants in this example. Consequently, to minimize the mass m of the shield, the radius R should be made as small as possible. This analysis suggests that the x-ray shield should be located as close as possible to the x-ray source 0, preferably inside of the x-ray tube envelope.

Figure 8:
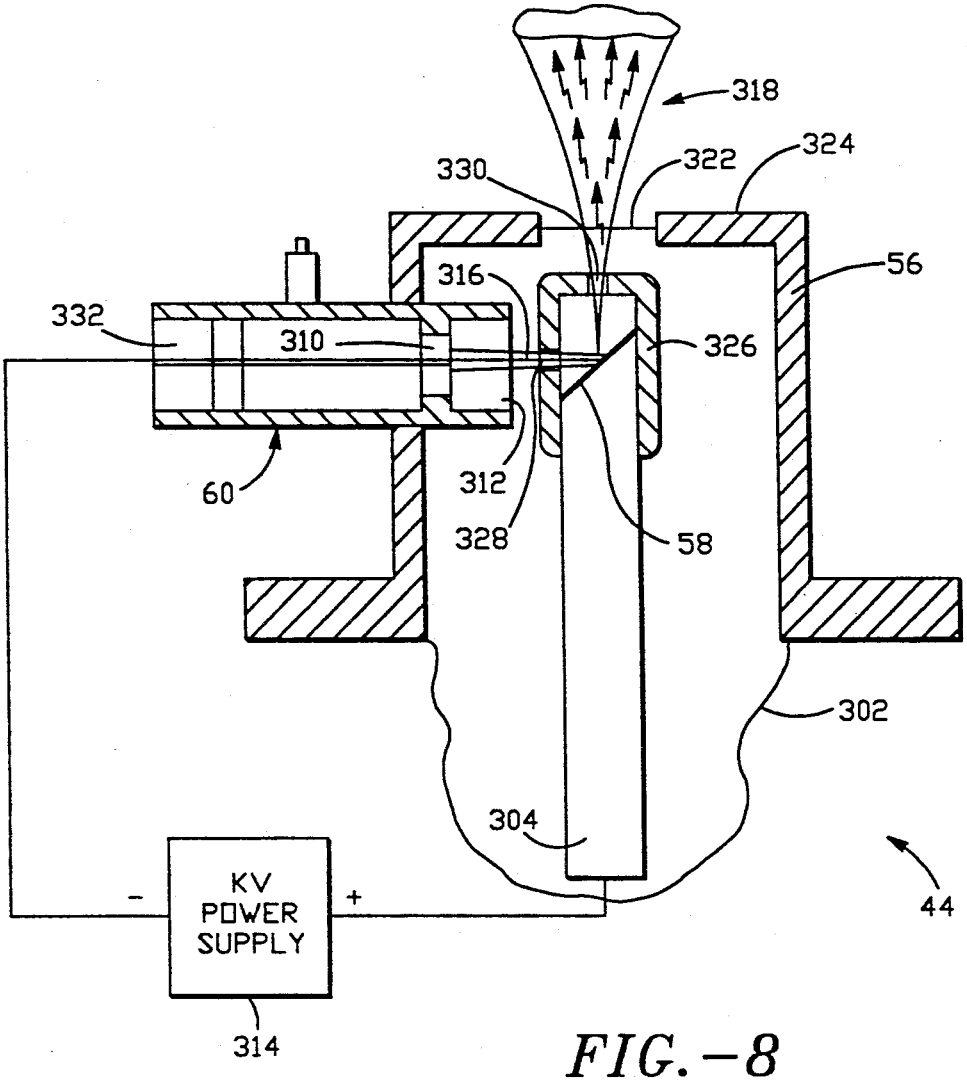
FIG. 8 is a diagrammatic sectional view of a generalized x-ray tube including internal shielding in accordance with principles of the present invention.

A generalization of the x-ray tube 44, incorporating these principles is depicted in FIG. 8, Therein, the tube 44 includes a glass envelope 302 (broken away to conserve drawing space), an anode support column 304 typically formed of copper rod and bonded to the glass envelope 302 with known metal to glass bonding techniques. The support column 304 is axially aligned and supported centrally by and within the envelope 302.

The x-ray target 58 is formed of a suitable target material such as tungsten. The target 58 is mounted adjacent an outer end of the tube 44. The electron gun assembly 60 includes the direct cathode heater 66, and a beam focusing cup 312. A very substantial potential difference (e.g. 5 kv to 70 kv, for example) is conventionally placed across the heater 66 and cathode 68, and the target 58, as shown diagrammatically in FIG. 7A by a KV power supply 314. This potential difference causes electrons freed by the heated cathode 68 to be formed into an electron beam 316 which is directed and drawn to the target 306 at sufficiently high velocity to result in the generation of x-ray photons 318.

As is conventional, the x-ray tube 44 includes a metal mounting flange portion 56 which is bonded to the glass envelope 302 and which, in this particular example mounts the electron gun assembly. See discussion of FIG. 3 of the referenced U.S. Pat. No. 4,646,338 for an alternative mounting arrangement for a grounded target x-ray tube. The thin x-ray translucent window 46 is provided in a radiation-emitting end 324 of the cylindrical shield and flange portion 56. As already noted above, the window 46 may be made of thin titanium sheet, and it enables the interior of the tube 44 to be highly evacuated of gas molecules, as is required for successful operation.

In accordance with the principles of the presently discussed aspect of the invention, a shield 326, formed of an x-ray absorptive material, such as tungsten or uranium, is disposed adjacently to surround and enclose the target 58. An electron beam opening 328 is defined through the shield 326, and an x-ray cone opening 330 is also defined through the shield 326. The openings 328 and 330 are small cylindrical openings in the shield 326. The opening 330 is provided with a size and thickness which enables it to act as a collimator in forming and limiting the x-ray cone of radiation.

X-rays back scattered through the electron beam opening 328 are absorbed by a second shield 332 e.g. located at the outer end of the electron beam assembly 60. The target 58 may be made sufficiently thick to absorb x-rays otherwise escaping through the central mounting post 304. Also, the flange 56 is provided with a thickness dimension which absorbs any x-radiation not effectively stopped by the central shield 326. As is illustrated in FIG. 8, the shield 326 may be made quite small, and have little relative mass compared with the other structural elements of the tube 44 and yet be very effective in absorbing x-radiation in all directions other than the window 46 and electron beam 316, while significantly reducing the weight otherwise required for safety shielding in a small x-ray source, such as the source system 10.

Figure 9:
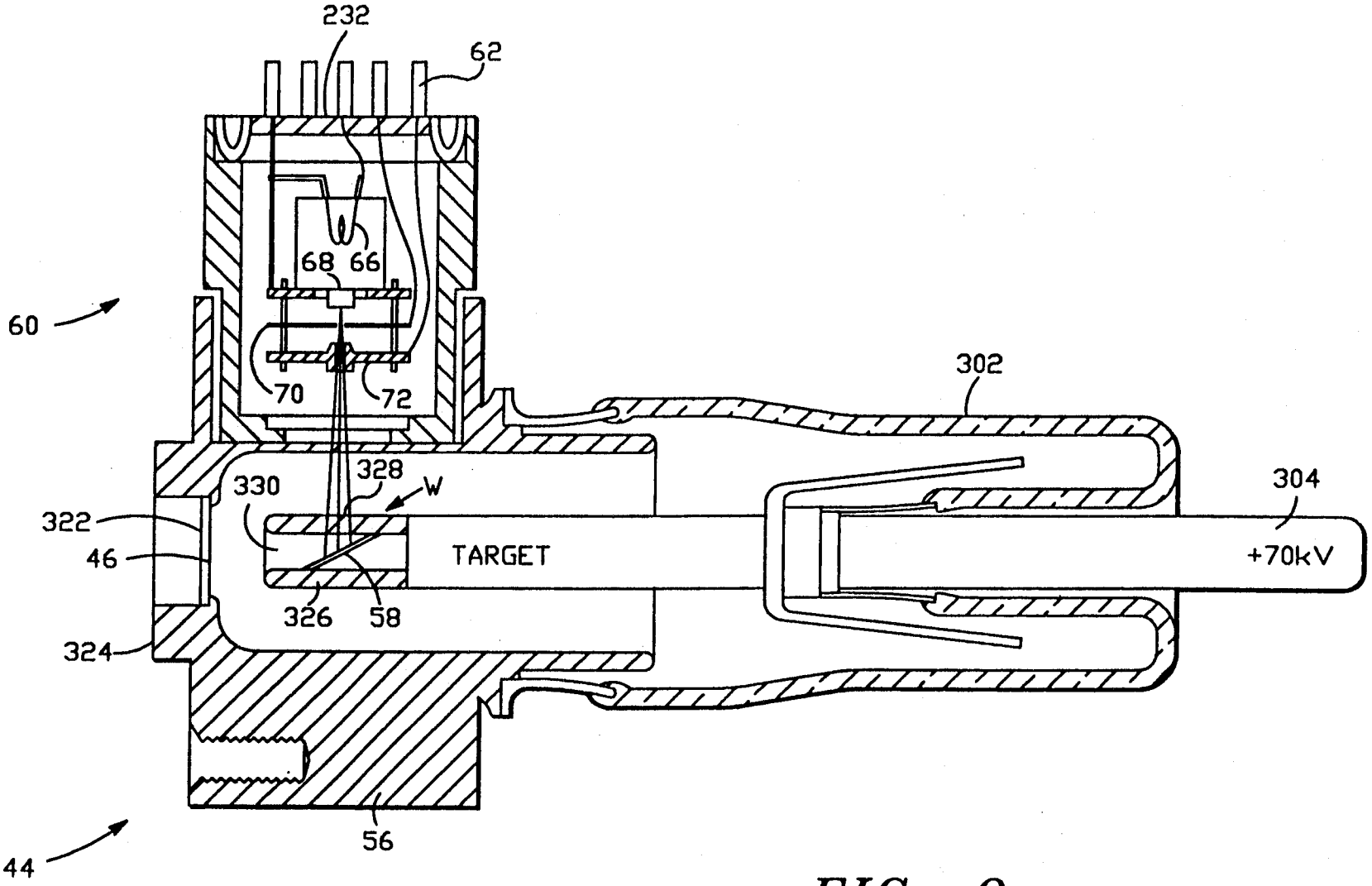
FIG. 9 is a sectional side view of an x-ray tube of the type depicted in FIGS. 7A and 7B are with both external and internal sheilding which has been specifically designed and adapted for use within the source depicted in FIG. 1.

The x-ray tube 44 depicted in FIG. 9 is a specific embodiment of the FIG. 8 generalization specifically for use within the source 10. The elements which are common to both tubes bear the same reference numerals and will not be duplicatively discussed.

During the manufacturing process, and during operation of the x-ray tube 44, it is essential not to overheat the cathode 68. Overheating the cathode 68 causes unwanted evaporation of barium ion cathodic material and redeposition onto the grid 70 and/or spot focus electrode 72. If such unwanted migration occurs, loss of precise pulse control of x-ray excitation ensues, since application of the high potential difference across the electron beam structure 60 and the target 58 will result in electron emission from the grid 70 and focus electrode 72, and resultant x-ray emission, irrespective of the fact that the cutoff potentials at the grid 70 and at the focus eleotrode 72 otherwise impede electron flow from the heated cathode 68.

Two considerations have been discovered to be essential to the successful operation of the source unit 10 for its intended purpose of providing precise control of x-ray pulse: The first consideration is providing a coating or impregnation of the cathode 68 with an osmium film or flashing. Such film or flashing has been found to enable the cathode 68 to emit electrons efficiently at a lower temperature, reducing the tendency of cathode ion material to migrate to the other elements of the electron gun structure 60. The second consideration has been the use of a titanium-molybdenum-zirconium alloy for the focus electrode 72. This alloy minimizes electron emission from cathode ions that may become redeposited on the focus electrode and provides an effective and complete pinch off of the electron beam, even in the presence of +70 kilovolts at the target anode.

While apparatus of the present invention has been summarized and explained by illustrative application of a portable high power pulsed precision x-ray source unit including an integrally self shielding, weight reduced x-ray tube, it will be readily apparent to those skilled in the art that many widely varying embodiments and applications are within the teachings and scope of the present invention, and that the examples presented herein are by way of illustration only and should not be construed as limiting the scope of the present invention as more particularly defined by the following claims:

We claim:

1. An integral high voltage generator for a ruggedized hand held precision x-ray source including an x-ray tube, the source being contained in a ruggedized handholdable housing and useful for generating bursts of x-ray photons having precisely regulated intensity level, energy level extending to at least 70 kilovolts, x-ray beam focus and burst duration, the x-ray tube having a heater, a heater power supply and an indirectly heated thermionic emission cathode electrode, a control grid, a focus electrode and a control grid and focus electrode power supply and an anode for emitting said bursts of x-ray photons as a consequence of bombardment of an accelerated electron beam pulse emitted by said cathode along a path leading to said anode, said integral generator including:

switching power supply means including an elongated, unitary, molded block mounted in the housing, the block having two generally parallel, externally cylindrical tube sections joined together along a rear portion of a central longitudinal axis; high voltage transformer means having primary and secondary annular windings encased in a transformer portion of the block, said transformer portion having an inside periphery generally tangent to the central longitudinal axis thereof, and defining a central opening outside of the block for receiving transformer core means therethrough; a two part capacitor-diode voltage multiplier stack having center nodes thereof connected to said secondary winding and having a positive node connectable to said anode and a negative node connectable to said cathode, a positive terminal providing part of said capacitor-diode voltage multiplier stack being formed in one of said cylindrical tube sections, and a negative terminal providing part of said capacitor-diode voltage multiplier stack being formed in another of said cylindrical tube section; said one cylindrical tube section defining a well for receiving said x-ray tube therein in a manner by which said anode is thereupon electrically connected to a positive terminal of said positive terminal providing part.

2. The high voltage generator as set forth in claim 1 wherein said cathode is adapted for operation at approximately ground potential.

3. The high voltage generator as set forth in claim 1 further comprising x-ray photon energy absorptive shielding material surrounding said one cylindrical tube section.

4. The high voltage generator as set forth in claim 1 wherein said x-ray tube further includes a window through which x-rays emitted by said anode pass to the ambient, and internal shielding means surrounding said anode for absorbing x-rays emitted by said anode in directions other than direction from which said electron beam strikes said anode and a direction leading to said window.

5. A pulsed precision x-ray source including an x-ray tube and integral generator system operable directly from a low voltage source and contained in a hand-holdable housing for generating timed intervals of x-ray photons having regulated intensity and energy level, and being emitted from an anode target area approaching a point source x-ray emitter; the system comprising, said x-ray tube having a heater and an indirectly heated thermionic emission cathode; said anode target area emitting x-rays as a consequence of bombardment of an accelerated electron beam emitted by said cathode along a path leading to said anode; a control grid disposed along said path through which said beam passes for controlling said beam, and a beam focus electrode for focusing said beam and directing it towards the target area of said anode, said integral generator system including:

a unitary, molded plastic block structure mounted in the housing and including high voltage transformer means having primary and secondary annular windings encased in a transformer portion of the block and, a Cockcroft-Walton capacitor-diode voltage multiplier stack connected to said secondary winding and having a positive node connectable to said anode and a negative node connectable to ground, high voltage pulse width modulated switching means connected to said primary annular winding for passing switching currents therethrough in order to generate controlled high voltages across said voltage multiplier stack in order to control the energy of x-ray photons put out by said x-ray tube, heater power supply means for supplying regulated heater current to operate said x-ray tube heater at a regulated maximum temperature, control voltage generation means for generating a grid control voltage for application to said control grid and for generating a focus voltage for application to said focus electrode, grid control means connected for controlling application of said grid control voltage to said control grid of said x-ray tube in order to switch said beam on during a beam-on pulse time, said grid control means including timing circuit means for establishing the duration of the beam-on pulse time in accordance with a presettable value.

6. The pulsed precision x-ray source as set forth in claim 5 wherein said timing circuit means further comprises duty cycle timing means for establishing a controllable duty cycle limiting time interval which limits the time between subsequent beam-on pulse times to a preestablished value.

7. The pulsed precision x-ray source as set forth in claim 5 wherein said integral generator means includes conditioning means for applying high voltage and heater current to said x-ray tube while maintaining said beam switched off during a conditioning interval so as to remove accumulated gas ions from said x-ray tube to prevent arc over during beam-on operations thereof.

8. The pulsed precision x-ray source as set forth in claim 7 wherein said conditioning means includes conditioning interval timing means for terminating said conditioning interval after a predetermined duration.

9. The pulsed precision x-ray source as set forth in claim 8 wherein said conditioning means further comprises voltage ramp generator means for positively increasing the high voltage applied to the anode in accordance with a positive ramp characteristic during the conditioning interval.

10. The pulsed precision x-ray source as set forth in claim 5 wherein said heater power supply means includes heater boost timer means for supplying increased heater current during an initial warm-up portion of each beam-on operation in order thereby to bring said x-ray tube heater rapidly to operating temperature.

11. The pulsed precision x-ray source as set forth in claim 10 further comprising time out means for limiting the occurrence of operation of the heater boost timer means so as to protect the x-ray tube heater from overheating.

12. The pulsed precision x-ray source as set forth in claim 5 wherein said grid control voltage generation means generates and applies a negative potential to the focus electrode and generates and applies a negative potential to the grid during beam off time intervals and said grid control voltage generation means generates a positive focus voltage relative to said cathode and applies a controlled amount of said positive focus voltage to said beam focus electrode during the beam-on pulse time.

13. The pulsed precision x-ray source as set forth in claim 5 wherein said control voltage generation means includes a switching power supply for generating a negative control voltage for application to said control grid and to said beam focus electrode during operation of the source other than during the beam-on pulse time to pinch off the electron beam within the x-ray tube and for generating a positive focus voltage for application to said beam focus electrode during the beam-on pulse time, and wherein said grid control means comprises switching means for switching the control grid to ground and the beam focus electrode to the positive focus voltage during the beam-on pulse time.

14. The pulsed precision x-ray source as set forth in claim 5 wherein said cathode of said x-ray tube includes a cathode bias resistor network thereby to establish positive cathode bias voltage relative to said control grid means during the beam-on pulse time and thereby achieve electron beam self regulation.

15. The pulsed precision x-ray source as set forth in claim 5 wherein each of said heater voltage generation means and said grid control voltage generation means comprises a pulse width modulator.

16. The pulsed precision x-ray source as set forth in claim 5 further comprising sense resistor means connected to said voltage multiplier stack for sensing the high voltage applied to the anode of the x-ray tube, reference voltage generation and selection means for generating a reference voltage corresponding to a desired high voltage, first comparator means for comparing sensed high voltage with the reference voltage and for generating an error signal indicative of a difference therebetween and for applying the error signal to control the high voltage pulse width modulated switching means so as to bring sensed high voltage into correspondence with desired high voltage.

17. The pulsed precision x-ray source as set forth in claim 5 further comprising sense resistor means connected to said voltage multiplier stack for sensing the high voltage applied to the anode of the x-ray tube, reference voltage generation and selection means for generating a reference voltage corresponding to a desired high voltage, second comparator means for comparing sensed high voltage with the reference voltage and for generating a signal indicative that sensed high voltage has reached a level approximating desired high voltage and for thereupon enabling said timing circuit means so that the beam-on pulse time may thereafter occur.

18. The pulsed precision x-ray source as set forth in claim 5 wherein the low voltage source comprises a battery and further comprising low battery voltage monitor circuit means for monitoring the voltage put out by the battery and for preventing operation of the source when battery voltage has fallen below a minimum level.

19. An x-ray tube for a pulsed precision x-ray source including the x-ray tube and an integral generator system capable of generating energy levels to at least 70 kilovolts, said x-ray tube having an electron gun assembly comprising a heater, a heated thermionic emission cathode operating at a regulated temperature at approximately ground potential, a control grid, and a beam focus electrode comprised of a material which effectively minimizes secondary electron emission in the presence of kilovoltage electric fields between the electron gun and an anode, the x-ray tube anode for emitting x-rays as a consequence of bombardment of an accelerated electron beam emitted by said electron gun assembly along a path leading to said anode, a window through which x-rays emitted by said anode pass to the ambient, and internal shielding means directly surrounding said anode for absorbing x-rays emitted by said anode in all directions other than a first direction from which said electron beam approaches said anode to impact thereon, and a second direction defining a cone of x-radiation leading to said window.

20. The x-ray tube set forth in claim 19 wherein said tube comprises in part a metallic housing surrounding said anode, said housing providing secondary x-ray shielding for further absorption of x-radiation from directions other than said second direction.

21. The x-ray tube set forth in claim 20 wherein said electron gun extends through said metallic housing.

22. The x-ray tube set forth in claim 21 wherein said electron beam forming structure is provided with x-ray absorbtive material for absorbing x-radiation back scattered in said first direction.

23. The x-ray tube set forth in claim 19 wherein said internal shielding means defines an opening forming a collimator for shaping and defining said cone of x-radiation emitted from said anode in said second direction.

24. The x-ray tube set forth in claim 19 wherein said anode is formed at an angle of approximately forty five degrees at one end of an elongated cylindrical electrode member leading rearwardly from the window and having a major axis in alignment with the window, and wherein the heated thermionic emission cathode, grid, and focus electrode contained in the electron gun structure are aligned along said first direction at approximately a right angle with respect to the anode end of the electrode member, so that the angle of incidence from the electron gun structure at the anode is approximately forty five degrees, and so that the angle of x-rays emanating from the anode and passing through the shielding means along said second direction and the window is approximately forty five degrees, and wherein the shielding means is cylindrically disposed about said anode.

25. The x-ray tube set forth in claim 19 wherein the cathode electrode is flashed with an osmium flashing so that the cathode electrode emits electrons at a lower heater temperature than otherwise.

26. The x-ray tube set forth in claim 19 wherein the focus electrode is constructed of an alloy of titanium, molybdenum and zirconium.

27. A precise x-ray pulse generating apparatus for generating an x-ray pulse of precise energy, intensity and duration, the apparatus including a housing and comprising:

shielded x-ray tube means in the housing including an evacuated envelope, electron gun means and a target disposed in facing relation in the envelope and an x-ray window for passing x-rays emitted from the target, the electron gun means for generating an electron beam pulse during beam-on precise intervals and for effectively inhibiting electron flow in the presence of high voltage fields during an operational interval other than a said beam-on interval therein, the electron gun means including an indirectly heated thermionic emission cathode electrode, a control grid and a focus electrode.

DC switching high voltage DC generator means for generating and applying one of a presettable plurality of kilovoltage potentials across the electron gun means and the target during the operational interval, DC switching heater power supply means for generating and applying current to a heater for heating the cathode, the heater power supply means including regulation means for regulating the heater current to keep the heater from exceeding a maximum temperature, DC switching control grid and focus electrode power supply means for generating and applying control voltages to the control grid and to the focus electrode, beam interval control means including monitor means for monitoring the one kilovoltage potential applied across the electron gun and the target of the x-ray tube to ascertain that the said potential has substantially reached its preset value, presettable timer means responsive to the monitor means and to an external excitation signal for generating a control pulse having a preset duration, the control pulse for controlling the DC switching control grid and focus electrode power supply means for changing bias voltages applied to the control grid and to the focus electrode during the duration of the control pulse thereby to cause the said electron beam-on interval.

28. The precise x-ray pulse generating apparatus set forth in claim 27 wherein the cathode electrode is flashed with an osmium flashing so that the cathode electrode emits electrons at a lower heater temperature than otherwise.

29. The precise x-ray pulse generating apparatus set forth in claim 27 wherein the focus electrode is constructed of an alloy of titanium, molybdenum and zirconium.

30. The precise x-ray pulse generating apparatus set forth in claim 27 wherein the DC switching high voltage DC generator means comprises an elongated, unitary, molded block mounted in the housing, the block having two generally parallel, cylindrical tube sections joined together along a rear portion of a central longitudinal axis; high voltage transformer means having primary and secondary annular windings encased in a transformer portion of the block, said transformer portion having an inside periphery generally tangent to the central longitudinal axis thereof, and defining a central opening outside of the block for receiving transformer core means therethrough; a two part capacitor-diode voltage multiplier stack having center nodes thereof connected to said secondary winding and having a positive node connectable to said anode and a negative node connectable to said cathode, a positive terminal providing part of said capacitor-diode voltage multiplier stack being formed in one of said cylindrical tube sections, and a negative terminal providing part of said capacitor-diode voltage multiplier stack being formed in another of said cylindrical tube section; said one cylindrical tube section defining a well for receiving said x-ray tube means therein in a manner by which said target electrode is thereupon electrically connected to a positive terminal of said positive terminal providing part.

31. The precise x-ray pulse generating apparatus set forth in claim 27 wherein the target of the x-ray tube means is formed at an angle of approximately forty five degrees at one end of an elongated cylindrical electrode member leading rearwardly from the window the electrode member including a cylindrical segment for providing shielding means within the x-ray tube and having a major axis in alignment with the window, and wherein the heated thermionic emission cathode, grid, and focus electrode contained in the electron gun structure are aligned along said first direction at a right angel with respect to the anode end of the electrode member, so that the angle of incidence from the electron gun structure at the anode is approximately forty five degrees, and so that the angle of x-rays emanating from the anode and passing through the shielding means along said second direction and the window is approximately forty five degrees, and wherein the shielding means surrounds said anode and defines openings to admit the electron beam to the anode and to pass the x-rays from the anode toward the window.

32. The precise x ray pulse generating apparatus set forth in claim 27 adapted for battery operation and further comprising battery voltage monitoring means for monitoring voltage supplied from a storage battery, the battery voltage monitoring means including lock out means for preventing operation of the apparatus in the event that monitored battery voltage falls below a predetermined minimum voltage.

33. The precise x-ray pulse generating apparatus set forth in claim 27 wherein said beam interval control means further comprises duty cycle timing means for establishing a controllable duty cycle limiting time interval which limits the time between subsequent beam-on pulse times to a preestablished value 34. The precise x-ray pulse generating apparatus set forth in claim 27 wherein said high voltage DC generator means includes conditioning means for applying high voltage and heater current to said x-ray tube while maintaining said beam switched off during a conditioning interval so as to remove accumulated gas ions from said x-ray tube to prevent arc over during beam-on operations thereof.

35. The precise x-ray pulse generating apparatus set forth in claim 34 wherein said conditioning means includes conditioning interval timing means for terminating said conditioning interval after a predetermined duration.

36. The precise x-ray pulse generating apparatus set forth in claim 35 wherein said conditioning means further comprises voltage ramp generator means for positively increasing the high voltage applied to the anode in accordance with a positive ramp characteristic during the conditioning interval.

37. The precise x-ray pulse generating apparatus set forth in claim 27 wherein said DC switching heater power supply means includes heater boost timer means for supplying increased heater current during an initial warm-up portion of each beam-on operation in order thereby to bring said heater rapidly to operating temperature.

38. The precise x-ray pulse generating apparatus set forth in claim 37 further comprising time out means for limiting the occurrence of operation of the heater boost timer means so as to protect the x-ray tube heater from exceeding said maximum temperature.

39. The precise x-ray pulse generating apparatus as set forth in claim 27 wherein said cathode electrode of said x-ray tube means includes a cathode bias resistor network thereby to establish positive cathode bias voltage relative to said control grid during the beam-on pulse interval and thereby achieve electron beam self regulation.

40. The precise x-ray pulse generating apparatus set forth in claim 27 wherein each of said DC switching heater power supply means and said DC switching control grid and focus electrode power supply means comprises a pulse width modulator.

41. The precise x-ray pulse generating apparatus set forth in claim 27 wherein the housing comprises a ruggedized, hand held housing of high impact absorptive material and further comprising a shield trumpet attachable to the housing at the window of the x-ray tube means for limiting the angle of incidence of the x-ray beam put out by the apparatus.

* * * * *